US008205692B2

(12) United States Patent
McDonough et al.

(10) Patent No.: US 8,205,692 B2
(45) Date of Patent: Jun. 26, 2012

(54) ROCK BIT AND INSERTS WITH A CHISEL CREST HAVING A BROADENED REGION

(75) Inventors: Scott D. McDonough, The Woodlands, TX (US); Brandon M. Moss, Houston, TX (US); James C. Minikus, Spring, TX (US)

(73) Assignee: Smith International, Inc., Houston, TX (US)

( * ) Notice: Subject to any disclaimer, the term of this patent is extended or adjusted under 35 U.S.C. 154(b) by 600 days.

(21) Appl. No.: 11/858,359

(22) Filed: Sep. 20, 2007

(65) Prior Publication Data

US 2008/0156543 A1 Jul. 3, 2008

Related U.S. Application Data

(60) Provisional application No. 60/883,251, filed on Jan. 3, 2007.

(51) Int. Cl.
*E21B 10/16* (2006.01)
*E21B 10/08* (2006.01)

(52) U.S. Cl. ..... 175/336; 175/327; 175/331; 175/374; 175/426

(58) Field of Classification Search ..... 175/327, 175/331, 374, 426, 336
See application file for complete search history.

(56) References Cited

U.S. PATENT DOCUMENTS

| | | | |
|---|---|---|---|
| 2,578,593 | A | 12/1951 | Phipps |
| 3,388,757 | A | 6/1968 | Fittinger |
| 3,442,342 | A | 5/1969 | McElya et al. |
| 3,946,820 | A | 3/1976 | Knapp |
| 4,056,153 | A | 11/1977 | Miglierini |
| 4,058,177 | A | 11/1977 | Langford, Jr. et al. |
| 4,086,973 | A | 5/1978 | Keller et al. |
| 4,108,260 | A | 8/1978 | Bozarth |
| 4,254,840 | A | 3/1981 | Shay, Jr. |
| 4,334,586 | A | 6/1982 | Schumacher |
| 4,352,400 | A | 10/1982 | Grappendorf et al. |

(Continued)

FOREIGN PATENT DOCUMENTS

| | | |
|---|---|---|
| EP | 0 391 683 | 10/1990 |

(Continued)

OTHER PUBLICATIONS

Office Action Dated Nov. 13, 2008 for U.S. Appl. No. 11/619,395 (pp. 14).

(Continued)

*Primary Examiner* — Thomas Beach
*Assistant Examiner* — James Sayre
(74) *Attorney, Agent, or Firm* — Christie, Parker & Hale, LLP

(57) ABSTRACT

A drill bit for cutting a borehole comprises a bit body. In addition, the drill bit comprises a rolling cone cutter mounted on the bit body and adapted for rotation about a cone axis. Further, the drill bit comprises at least one insert having a base portion secured in the rolling cone cutter and a cutting portion extending therefrom. The cutting portion includes a pair of flanking surfaces that taper towards one another to form an elongate chisel crest including a first crest end, a second crest end, and an apex positioned therebetween. A transverse radius of curvature at the first crest end is less than a transverse radius of curvature at the apex, and a transverse radius of curvature at the second crest end is less than the transverse radius of curvature at the apex.

16 Claims, 9 Drawing Sheets

U.S. PATENT DOCUMENTS

| | | | | |
|---|---|---|---|---|
| 4,511,006 | A | | 4/1985 | Grainger |
| 4,586,574 | A | | 5/1986 | Grappendorf |
| 4,716,977 | A | | 1/1988 | Huffstutler |
| 4,722,405 | A | | 2/1988 | Langford, Jr. |
| 4,811,801 | A | | 3/1989 | Salesky et al. |
| 4,832,139 | A | | 5/1989 | Minikus et al. |
| 4,854,405 | A | | 8/1989 | Stroud |
| 4,951,762 | A | | 8/1990 | Lundell |
| D324,527 | S | | 3/1992 | Slutz |
| 5,131,478 | A | | 7/1992 | Brett et al. |
| 5,172,777 | A | | 12/1992 | Siracki et al. |
| 5,172,779 | A | | 12/1992 | Siracki et al. |
| 5,197,555 | A | | 3/1993 | Estes |
| 5,201,376 | A | | 4/1993 | Williams |
| 5,303,787 | A | | 4/1994 | Brady |
| 5,322,138 | A | * | 6/1994 | Siracki ..... 175/374 |
| 5,323,865 | A | | 6/1994 | Isbell et al. |
| 5,341,890 | A | | 8/1994 | Cawthorne et al. |
| 5,351,768 | A | | 10/1994 | Scott et al. |
| 5,372,210 | A | | 12/1994 | Harrell |
| 5,379,854 | A | | 1/1995 | Dennis |
| 5,407,022 | A | | 4/1995 | Scott et al. |
| 5,415,244 | A | | 5/1995 | Portwood |
| 5,421,423 | A | | 6/1995 | Huffstutler |
| 5,421,424 | A | * | 6/1995 | Portwood et al. ..... 175/374 |
| 5,429,199 | A | | 7/1995 | Sheirer et al. |
| 5,429,200 | A | | 7/1995 | Blackman et al. |
| 5,452,771 | A | | 9/1995 | Blackman et al. |
| 5,479,997 | A | | 1/1996 | Scott et al. |
| 5,518,077 | A | | 5/1996 | Blackman et al. |
| 5,533,582 | A | | 7/1996 | Tibbitts |
| 5,535,839 | A | | 7/1996 | Brady |
| 5,542,485 | A | | 8/1996 | Pessier et al. |
| 5,560,440 | A | | 10/1996 | Tibbitts |
| 5,592,995 | A | | 1/1997 | Scott et al. |
| 5,636,700 | A | | 6/1997 | Shamburger, Jr. |
| 5,644,956 | A | | 7/1997 | Blackman et al. |
| 5,695,019 | A | | 12/1997 | Shamburger, Jr. |
| 5,697,462 | A | | 12/1997 | Grimes et al. |
| 5,709,278 | A | | 1/1998 | Crawford |
| 5,743,346 | A | | 4/1998 | Flood et al. |
| 5,746,280 | A | | 5/1998 | Scott et al. |
| 5,752,573 | A | | 5/1998 | Scott et al. |
| 5,755,301 | A | | 5/1998 | Love et al. |
| 5,813,485 | A | | 9/1998 | Portwood |
| 5,819,861 | A | | 10/1998 | Scott et al. |
| 5,833,020 | A | | 11/1998 | Portwood et al. |
| 5,839,526 | A | | 11/1998 | Cisneros et al. |
| 5,871,060 | A | | 2/1999 | Jensen et al. |
| 5,874,060 | A | | 2/1999 | Armour et al. |
| 5,881,828 | A | | 3/1999 | Fischer et al. |
| 5,887,655 | A | | 3/1999 | Haugen et al. |
| 5,887,668 | A | | 3/1999 | Haugen et al. |
| 5,890,550 | A | | 4/1999 | Swadi et al. |
| 5,915,486 | A | | 6/1999 | Portwood et al. |
| 5,950,745 | A | | 9/1999 | Ingmarsson |
| 5,967,245 | A | | 10/1999 | Garcia et al. |
| 6,029,759 | A | | 2/2000 | Sue et al. |
| 6,053,263 | A | | 4/2000 | Meiners |
| 6,059,054 | A | | 5/2000 | Portwood et al. |
| 6,105,693 | A | | 8/2000 | Ingmarsson |
| 6,105,694 | A | | 8/2000 | Scott |
| D430,578 | S | | 9/2000 | Brady |
| 6,161,634 | A | | 12/2000 | Minikus et al. |
| 6,176,332 | B1 | | 1/2001 | Massa et al. |
| 6,176,333 | B1 | | 1/2001 | Doster |
| 6,196,340 | B1 | | 3/2001 | Jensen et al. |
| 6,199,645 | B1 | | 3/2001 | Anderson et al. |
| 6,202,752 | B1 | | 3/2001 | Kuck et al. |
| 6,241,034 | B1 | | 6/2001 | Steinke et al. |
| 6,241,035 | B1 | | 6/2001 | Portwood |
| 6,290,008 | B1 | | 9/2001 | Portwood et al. |
| 6,367,568 | B2 | | 4/2002 | Steinke et al. |
| 6,510,910 | B2 | | 1/2003 | Eyre et al. |
| 6,530,441 | B1 | | 3/2003 | Singh et al. |
| 6,561,293 | B2 | | 5/2003 | Minikus et al. |
| 6,595,305 | B1 | | 7/2003 | Dunn et al. |
| 6,601,662 | B2 | | 8/2003 | Matthias et al. |
| 6,745,645 | B2 | | 6/2004 | Griffo |
| 6,782,959 | B2 | | 8/2004 | Minikus et al. |
| 6,883,624 | B2 | | 4/2005 | McDonough |
| 6,929,079 | B2 | | 8/2005 | McDonough et al. |
| 7,013,999 | B2 | | 3/2006 | Tufts |
| 7,040,424 | B2 | | 5/2006 | Yong et al. |
| 7,152,703 | B2 | | 12/2006 | Meiners et al. |
| 2004/0173384 | A1 | | 9/2004 | Yong et al. |
| 2005/0247492 | A1 | | 11/2005 | Shen et al. |

FOREIGN PATENT DOCUMENTS

| | | |
|---|---|---|
| EP | 0 446 765 | 9/1991 |
| EP | 0 527 506 | 2/1993 |
| EP | 0 902 159 | 3/1999 |
| GB | 2 361 497 | 10/2001 |
| GB | 2 369 841 | 6/2002 |
| GB | 2 393 982 | 4/2004 |
| GB | 2398330 | 8/2004 |
| RU | 2105124 | 2/1998 |
| RU | 2153569 | 7/2000 |
| WO | WO 01/61142 | 8/2001 |

OTHER PUBLICATIONS

Office Action Dated Nov. 24, 2008 for U.S. Appl. No. 11/619,416 (11 p.).

Response to Office Action Dated Nov. 24, 2008 for U.S. Appl. No. 11/619,416 (17 p.).

Final Office Action Dated May 22, 2009 for U.S. Appl. No. 11/619,416 (20 p.).

Response to Final Office Action Dated May 22, 2009 for U.S. Appl. No. 11/619,416 (22 p).

Office Action Dated May 17, 2007 for U.S. Appl. No. 11/157,656 (18 p.).

Response to Office Action Dated May 17, 2007 for U.S. Appl. No. 11/157,656 (23 p.).

Office Action Dated Aug. 31, 2007 for U.S. Appl. No. 11/157,656 (12 p.).

Response to Office Action Dated Aug. 31, 2007 for U.S. Appl. No. 11/157,656 (19 p.).

Final Office Action Dated Feb. 19, 2008 for U.S. Appl. No. 11/157,656 (18 p.).

Response to Final Office Action Dated Feb. 19, 2008 for U.S. Appl. No. 11/157,656 (15 p.).

Advisory Action Dated May 5, 2008 for U.S. Appl. No. 11/157,656 (3 p.).

Request for Continued Examination (RCE) and Preliminary Amendment; for U.S. Appl. No. 11/157,656 (25 p.).

Office Action Dated Oct. 17, 2008 for U.S. Appl. No. 11/157,656 (4 p.).

Response to Office Action Dated Oct. 17, 2008 for U.S. Appl. No. 11/157,656 (5 p.).

Notice of Allowance and Fee(s) Due Dated Dec. 8, 2008 for U.S. Appl. No. 11/157,656 (4 p.).

Office Action Dated Apr. 29, 2009 for U.S. Appl. No. 11/157,656 (8 p.).

Response to Office Action Dated Apr. 22, 2009 for U.S. Appl. No. 11/157,656 (16 p.).

Office Action Dated Jul. 9, 2009 for U.S. Appl. No. 11/947,226 (13 p.).

Office Action Dated Sep. 3, 2004 for U.S. Appl. No. 10/371,388 (5 p.).

Response to Office Action Dated Sep. 3, 2004 for U.S. Appl. No. 10/371,388 (15 p.).

Notice of Allowance for U.S. Appl. No. 10/371,388 dated Apr. 13, 2005 (6 p).

Office Action Dated Sep. 23, 2004 for U.S. Appl. No. 10/379,015 (12 p.).

Response to Office Action Dated Sep. 23, 2004 for U.S. Appl. No. 10/379,015 (23 p).

Office Action Dated Feb. 22, 2005 for U.S. Appl. No. 10/379,015 (7 p.).

Response to Office Action Dated Feb. 22, 2005 for U.S. Appl. No. 10/379,015 (19 p).

Office Action dated Aug. 29, 2006 for U.S. Appl. No. 10/379,015 (7 p.).
Response to Office Action dated Aug. 29, 2006 for U.S. Appl. No. 10/379,015 (19 p.).
Notice of Allowance dated Jan. 31, 2006 for U.S. Appl. No. 10/379,016 (6 p.).
Office Action Dated Apr. 28, 2005 for U.S. Appl. No. 10/628,191 (12 p.).
Response to Office Action Dated Apr. 28, 2005 for U.S. Appl. No. 10/628,191 (26 p.).
Notice of Allowance Dated Oct. 12, 2005 for U.S. Appl. No. 10/628,191 (4 p.).
Office Action Dated Apr. 13, 2004 for U.S. Appl. No. 10/355,493 (10 p.).
Response to Office Action Dated Apr. 13, 2004 for U.S. Appl. No. 10/355,493 (32 p.).
Final Office Action Dated Aug. 23, 2004 for U.S. Appl. No. 10/355,493 (7 p.).
Response to Final Office Action Dated Aug. 23, 2004 for U.S. Appl. No. 10/355,493 (19 p).
Notice of Allowance Dated Dec. 20, 2004 for U.S. Appl. No. 10/355,493 (6 p).
Response to Office Action Dated Nov. 13, 2008 for U.S. Appl. No. 11/619,395 (21 p.).
Notice of Allowance dated Apr. 20, 2009 for U.S. Appl. No. 11/619,395 (6 p.).
Search Report for Appln. No. GB 0 403 620.8 dated May 5, 2004 (2 p.).
Search Report for Appln. No. GB 0 402 108.5 dated Apr. 22, 2004; (1 p.).
Search Report for Appln. No. GB 0 416617.9 dated Sep. 9, 2004; (1 p.).
Search Report for Appln. No. GB 0404709.8 dated Sep. 23, 2004; (1 p.).
Final Office Action Dated Feb. 18, 2010 for U.S. Appl. No. 11/947,226 (23 p.).
Request for Continued Examination and Response to Final Office Action Dated Feb. 18, 2010 for U.S. Appl. No. 11/947,226; (20 p.).
Supplemental Response to Final Office Action Dated May 22, 2009 for U.S. Appl. No. 11/619,416; (18 p.).
Advisory Action Dated Aug. 7, 2009 for U.S. Appl. No. 11/619,416; (3 p.).
Notice of Allowance and Fee(s) Due dated Mar. 1, 2010 for U.S. Appl. No. 11/157,656; (9 p.).
Notice of Allowance and Fee(s) Due dated Nov. 16, 2009 for U.S. Appl. No. 11/619,416; (9 p.).
Response Office Action Dated Jul. 9, 2009 for U.S. Appl. No. 11/947,226; (15 p.).
Chisel-crested insert for rolling cone drill bit; Smith International, Inc.; (1 pg. drawing—Exhibit 1).
Chisel-crested insert for rolling cone drill bit; Smith International, Inc.; (1 pg. drawing—Exhibit 2).
Chisel-crested insert for rolling cone drill bit; Smith International, Inc.; (1 pg. drawing—Exhibit 3).

* cited by examiner

ROCK BIT AND INSERTS WITH A CHISEL CREST HAVING A BROADENED REGION

CROSS-REFERENCE TO RELATED APPLICATIONS

This application claims benefit of U.S. provisional application Ser. No. 60/883,251 filed Jan. 3, 2007, and entitled "Drill Bit and Inserts with a Chisel Crest Having a Broadened Region," which is hereby incorporated herein by reference in its entirety.

STATEMENT REGARDING FEDERALLY SPONSORED RESEARCH OR DEVELOPMENT

Not Applicable.

BACKGROUND OF THE TECHNOLOGY

1. Field of the Invention

The invention relates generally to earth-boring bits used to drill a borehole for the ultimate recovery of oil, gas or minerals. More particularly, the invention relates to rolling cone rock bits and to an improved cutting structure and inserts for such bits.

2. Background Information

An earth-boring drill bit is typically mounted on the lower end of a drill string and is rotated by revolving the drill string at the surface or by actuation of downhole motors or turbines, or by both methods. With weight applied to the drill string, the rotating drill bit engages the earthen formation and proceeds to form a borehole along a predetermined path toward a target zone. The borehole formed in the drilling process will have a diameter generally equal to the diameter or "gage" of the drill bit. The length of time that a drill bit may be employed before it must be changed depends upon its ability to "hold gage" (meaning its ability to maintain a full gage borehole diameter), its rate of penetration ("ROP"), as well as its durability or ability to maintain an acceptable ROP.

In oil and gas drilling, the cost of drilling a borehole is proportional to the length of time it takes to drill to the desired depth and location. The time required to drill the well, in turn, is greatly affected by the number of times the drill bit must be changed in order to reach the targeted formation. This is the case because each time the bit is changed, the entire string of drill pipes, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. Because drilling costs are typically thousands of dollars per hour, it is thus always desirable to employ drill bits which will drill faster and longer and which are usable over a wider range of formation hardness.

One common earth-boring bit includes one or more rotatable cone cutters that perform their cutting function due to the rolling movement of the cone cutters acting against the formation material. The cone cutters roll and slide upon the bottom of the borehole as the bit is rotated, the cone cutters thereby engaging and disintegrating the formation material in its path. The rotatable cone cutters may be described as generally conical in shape and are therefore sometimes referred to as rolling cones, cone cutters, or the like. The borehole is formed as the gouging and scraping or crushing and chipping action of the rotary cones removes chips of formation material which are carried upward and out of the borehole by drilling fluid which is pumped downwardly through the drill pipe and out of the bit.

The earth disintegrating action of the rolling cone cutters is enhanced by providing the cone cutters with a plurality of cutter elements. Cutter elements are generally of two types: inserts formed of a very hard material, such as tungsten carbide, that are press fit into undersized apertures in the cone surface; or teeth that are milled, cast or otherwise integrally formed from the material of the rolling cone. Bits having tungsten carbide inserts are typically referred to as "TCI" bits or "insert" bits, while those having teeth formed from the cone material are commonly known as "steel tooth bits." In each instance, the cutter elements on the rotating cone cutters break up the formation to form new boreholes by a combination of gouging and scraping or chipping and crushing. The shape and positioning of the cutter elements (both steel teeth and tungsten carbide inserts) upon the cone cutters greatly impact bit durability and ROP and thus, are important to the success of a particular bit design.

The inserts in TCI bits are typically positioned in circumferential rows on the rolling cone cutters. Most such bits include a row of inserts in the heel surface of the rolling cone cutters. The heel surface is a generally frustoconical surface configured and positioned so as to align generally with and ream the sidewall of the borehole as the bit rotates. In addition, conventional bits also typically include a circumferential gage row of cutter elements mounted adjacent to the heel surface but oriented and sized in such a manner so as to cut the corner of the borehole. Further, conventional bits also include a number of inner rows of cutter elements that are located in circumferential rows disposed radially inward or in board from the gage row. These cutter elements are sized and configured for cutting the bottom of the borehole, and are typically described as inner row cutter elements or bottom hole cutter elements.

Inserts in TCI bits have been provided with various geometries. One insert typically employed in an inner row may generally be described as a "conical" insert, having a cutting surface that tapers from a cylindrical base to a generally rounded or spherical apex. As a result of this geometry, the front and side profile views of most conventional conical inserts are the same. Such an insert is shown, for example, in FIGS. 4A-C in U.S. Pat. No. 6,241,034. Conical inserts have particular utility in relatively hard formations as the weight applied to the formation through the insert is concentrated, at least initially, on the relatively small surface area of the apex. However, because of the conical insert's relatively narrow profile, in softer formations, it is not able to remove formation material as quickly as would an insert having a wider cutting profile.

Another common shape for an insert for use in inner rows may generally be described as "chisel" shaped. Rather than having the spherical apex of the conical insert, a chisel insert includes two generally flattened sides or flanks that converge and terminate in an elongate crest at the terminal end of the insert. As a result of this geometry, the front profile view of a conventional chisel crest is usually wider than the side profile view. The chisel element may have rather sharp transitions where the flanks intersect the more rounded portions of the cutting surface, as shown, for example, in FIGS. 1-8 in U.S. Pat. No. 5,172,779. In other designs, the surfaces of the chisel insert may be contoured or blended so as to eliminate sharp transitions and to present a more rounded cutting surface, such as shown in FIGS. 3A-D in U.S. Pat. No. 6,241,034 and FIGS. 9-12 in U.S. Pat. No. 5,172,779. In general, it has been understood that, as compared to a conical insert, the chisel-shaped insert provides a more aggressive cutting structure that removes formation material at a faster rate for as long as the cutting structure remains intact.

Despite this advantage of chisel-shaped inserts, however, such cutter elements have shortcomings when it comes to drilling in harder formations, where the relatively sharp cutting edges and chisel crest of the chisel insert endure high stresses and tend to be more susceptible to chipping and fracturing. Likewise, in hard and abrasive formations, the chisel crest may wear dramatically. Both wear and breakage may cause a bit's ROP to drop dramatically, as for example, from 80 feet per hour to less than 10 feet per hour. Once the cutting structure is damaged and the rate of penetration reduced to an unacceptable rate, the drill string must be removed in order to replace the drill bit. As mentioned, this "trip" of the drill string is extremely time consuming and expensive to the driller. For these reasons, in soft formations, chisel-shaped inserts are frequently preferred for bottom hole cutting.

Increasing ROP while maintaining good cutter and bit life to increase the footage drilled is still an important goal so as to decrease drilling time and recover valuable oil and gas more economically.

Accordingly, there remains a need in the art for a drill bit and cutting elements that will provide a relatively high rate of penetration and footage drilled, yet be durable enough to withstand hard and abrasive formations. Such drill bits and cutting elements would be particularly well received if they had geometries making them less susceptible to breakage.

BRIEF SUMMARY OF SOME OF THE PREFERRED EMBODIMENTS

In accordance with at least one embodiment, an insert for a drill bit comprises a base portion. In addition, the insert comprises a cutting portion extending from the base portion. The cutting portion includes a pair of flanking surfaces that taper towards one another to form an elongate chisel crest having a peaked ridge. Further, the elongate chisel crest extends between a first crest end and a second crest end, and has an apex positioned between the first and second crest ends, the apex defining an extension height for the insert. Moreover, a transverse cross-section at the apex has an apex transverse radius of curvature, a transverse cross-section at the first crest end has a first crest end transverse radius of curvature that is less than the apex transverse radius of curvature, and a transverse cross-section taken at the second crest end has a second crest end transverse radius of curvature that is less than the apex transverse radius of curvature. The apex transverse radius of curvature is at least 10% larger than the first crest end transverse radius of curvature, and at least 10% larger than the second crest end transverse radius of curvature.

In accordance with other embodiments, an insert for a drill bit comprises a base portion. In addition, the insert comprises a cutting portion extending from the base portion. The cutting portion includes a pair of flanking surfaces that taper towards one another to form an elongate chisel crest having a peaked ridge. Further, the elongate chisel crest extends between a first crest end and a second crest end, and has an apex positioned between the first and second crest ends, the apex defining an extension height for the insert. Moreover, the elongate chisel crest has a transverse radius of curvature that increases moving from the first crest end toward the apex, and increases moving from the second crest end towards the apex.

In accordance with still other embodiments, a drill bit for cutting a borehole having a borehole sidewall, corner and bottom comprises a bit body including a bit axis. In addition, the drill bit comprises a rolling cone cutter mounted on the bit body and adapted for rotation about a cone axis. Further, the drill bit comprises at least one insert having a base portion secured in the rolling cone cutter and having a cutting portion extending therefrom. The cutting portion includes a pair of flanking surfaces tapering towards one another to form an elongate chisel crest having a peaked ridge. Moreover, the elongate chisel crest extends between a first crest end and a second crest end, and has an apex positioned between the first and second crest ends, the apex defining an extension height of the at least one insert. A transverse cross-section at the apex has an apex transverse radius of curvature, a transverse cross-section at the first crest end has a first crest end transverse radius of curvature that is less than the apex transverse radius of curvature, and a transverse cross-section taken at the second crest end has a second crest end transverse radius of curvature that is less than the apex transverse radius of curvature. Still further, the apex transverse radius of curvature is at least 10% larger than the first crest end transverse radius of curvature, and at least 10% larger than the second crest end transverse radius of curvature.

In accordance with still other embodiments, a drill bit for cutting a borehole having a borehole sidewall, corner and bottom comprises a bit body including a bit axis. In addition, the drill bit comprises a rolling cone cutter mounted on the bit body and adapted for rotation about a cone axis. Further, the drill bit comprises at least one insert having a base portion secured in the rolling cone cutter and having a cutting portion extending therefrom. The cutting portion includes a pair of flanking surfaces tapering towards one another to form an elongate chisel crest having a peaked ridge. Moreover, the elongate chisel crest extends between a first crest end and a second crest end, and has an apex positioned between the first and second crest ends, the apex defining an extension height of the at least one insert. Still further, the elongate chisel crest has a transverse width at a uniform depth D measured perpendicularly from the peaked ridge, wherein the transverse width of the elongate crest increases moving from the first crest end toward the apex, and increases moving from the second crest end towards the apex, the ratio of the depth D to the extension height being 0.10.

Thus, the embodiments described herein comprise a combination of features providing the potential to overcome certain shortcomings associated with prior devices. The various characteristics described above, as well as other features, will be readily apparent to those skilled in the art upon reading the following detailed description of the preferred embodiments, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENTS

Figure 1:
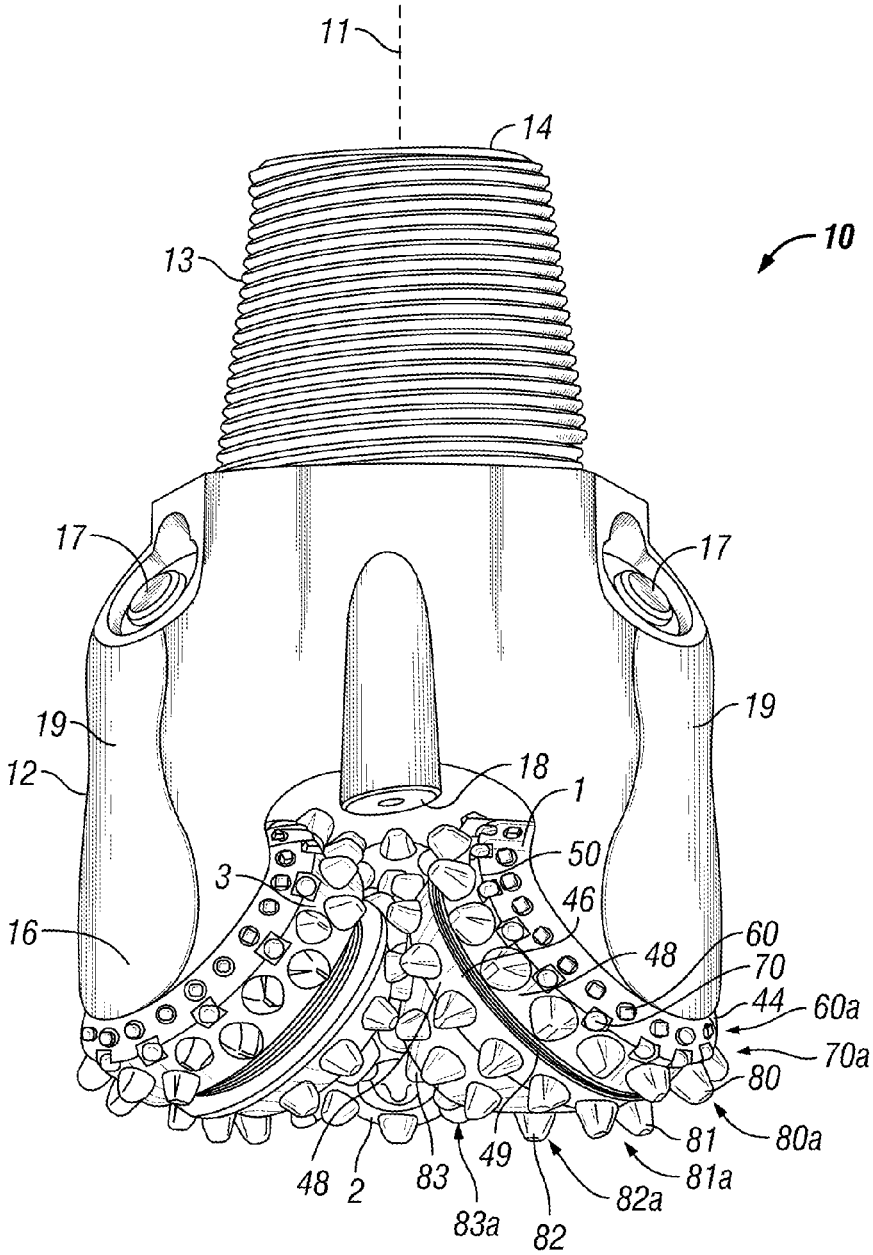
FIG. 1 is a perspective view of an earth-boring bit.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form, and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices and connections.

Referring first to FIG. 1, an earth-boring bit 10 is shown to include a central axis 11 and a bit body 12 having a threaded pin section 13 at its upper end that is adapted for securing the bit to a drill string (not shown). The uppermost end will be referred to herein as pin end 14. Bit 10 has a predetermined gage diameter as defined by the outermost reaches of three rolling cone cutters 1, 2, 3 which are rotatably mounted on bearing shafts that depend from the bit body 12. Bit body 12 is composed of three sections or legs 19 (two shown in FIG. 1) that are welded together to form bit body 12. Bit 10 further includes a plurality of nozzles 18 that are provided for directing drilling fluid toward the bottom of the borehole and around cone cutters 1-3. Bit 10 includes lubricant reservoirs 17 that supply lubricant to the bearings that support each of the cone cutters. Bit legs 19 include a shirttail portion 16 that serves to protect the cone bearings and cone seals from damage as might be caused by cuttings and debris entering between leg 19 and its respective cone cutter.

Figure 2:
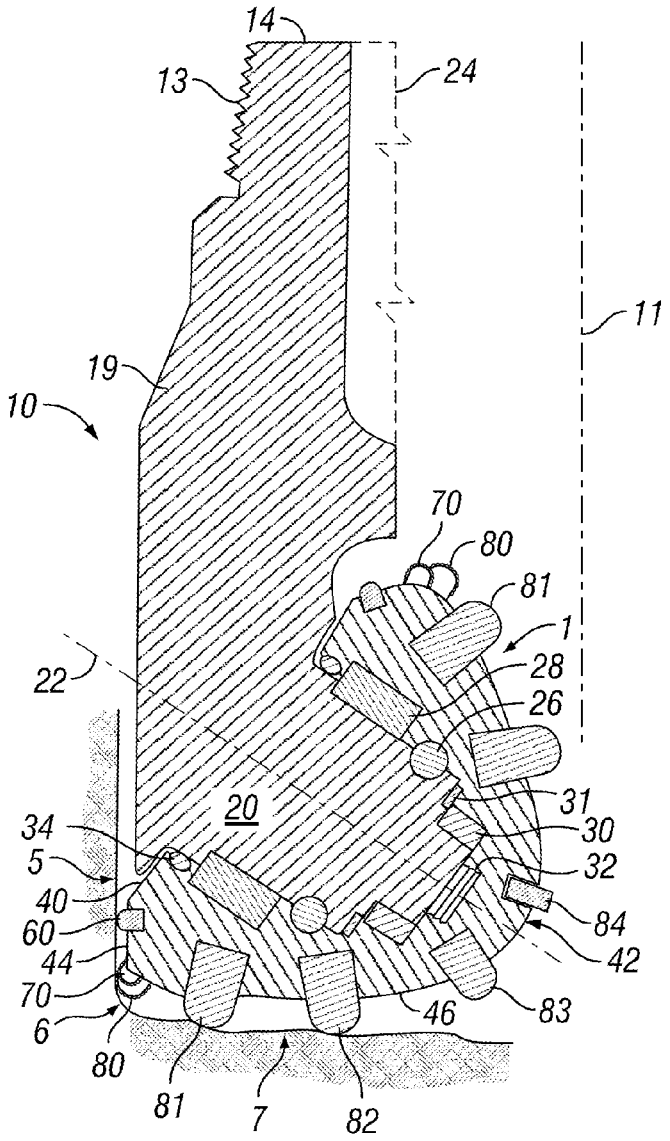
FIG. 2 is a partial section view taken through one leg and one rolling cone cutter of the bit shown in FIG. 1.

Referring now to both FIGS. 1 and 2, each cone cutter 1-3 is mounted on a pin or journal 20 extending from bit body 12, and is adapted to rotate about a cone axis of rotation 22 oriented generally downwardly and inwardly toward the center of the bit. Each cutter 1-3 is secured on pin 20 by locking balls 26, in a conventional manner. In the embodiment shown, radial and axial thrust are absorbed by roller bearings 28, 30, thrust washer 31 and thrust plug 32. The bearing structure shown is generally referred to as a roller bearing; however, the invention is not limited to use in bits having such structure, but may equally be applied in a bit where cone cutters 1-3 are mounted on pin 20 with a journal bearing or friction bearing disposed between the cone cutter and the journal pin 20. In both roller bearing and friction bearing bits, lubricant may be supplied from reservoir 17 to the bearings by apparatus and passageways that are omitted from the figures for clarity. The lubricant is sealed in the bearing structure, and drilling fluid excluded therefrom, by means of an annular seal 34 which may take many forms. Drilling fluid is pumped from the surface through fluid passage 24 where it is circulated through an internal passageway (not shown) to nozzles 18 (FIG. 1). The borehole created by bit 10 includes sidewall 5, corner portion 6 and bottom 7, best shown in FIG. 2.

Referring still to FIGS. 1 and 2, each cone cutter 1-3 includes a generally planar backface 40 and nose portion 42. Adjacent to backface 40, cutters 1-3 further include a generally frustoconical surface 44 that is adapted to retain cutter elements that scrape or ream the sidewalls of the borehole as the cone cutters rotate about the borehole bottom. Frustoconical surface 44 will be referred to herein as the "heel" surface of cone cutters 1-3. It is to be understood, however, that the same surface may be sometimes referred to by others in the art as the "gage" surface of a rolling cone cutter.

Extending between heel surface 44 and nose 42 is a generally conical surface 46 adapted for supporting cutter elements that gouge or crush the borehole bottom 7 as the cone cutters rotate about the borehole. Frustoconical heel surface 44 and conical surface 46 converge in a circumferential edge or shoulder 50, best shown in FIG. 1. Although referred to herein as an "edge" or "shoulder," it should be understood that shoulder 50 may be contoured, such as by a radius, to various degrees such that shoulder 50 will define a contoured zone of convergence between frustoconical heel surface 44 and the conical surface 46. Conical surface 46 is divided into a plurality of generally frustoconical regions or bands 48 generally referred to as "lands" which are employed to support and secure the cutter elements as described in more detail below. Grooves 49 are formed in cone surface 46 between adjacent lands 48.

In the bit shown in FIGS. 1 and 2, each cone cutter 1-3 includes a plurality of wear resistant cutter elements in the form of inserts which are disposed about the cone and arranged in circumferential rows in the embodiment shown. More specifically, rolling cone cutter 1 includes a plurality of heel inserts 60 that are secured in a circumferential row **60*a* in the frustoconical heel surface 44. Cone cutter 1 further includes a first circumferential row 70*a* of gage inserts 70 secured to cone cutter 1 in locations along or near the circumferential shoulder 50. Additionally, the cone cutter includes a second circumferential row 80*a* of gage inserts 80. The cutting surfaces of inserts 70, 80 have differing geometries, but each extends to full gage diameter. Row 70*a* of the gage inserts is sometimes referred to as the binary row and inserts 70 sometimes referred to as binary row inserts. The cone cutter 1 further includes inner row inserts 81, 82, 83 secured to cone surface 46 and arranged in concentric, spaced-apart inner rows 81*a*, 82*a*, 83*a*, respectively. Heel inserts 60 generally function to scrape or ream the borehole sidewall 5 to maintain the borehole at full gage and prevent erosion and abrasion of the heel surface 44. Gage inserts 80 function primarily to cut the corner of the borehole. Binary row inserts 70 function primarily to scrape the borehole wall and limit the scraping action of gage inserts 80 thereby preventing gage inserts 80** from wearing as rapidly as might otherwise occur.

Inner row cutter elements 81, 82, 83 of inner rows 81*a*, 82*a*, 83*a* are employed to gouge and remove formation material from the remainder of the borehole bottom 7. Insert rows 81*a*, 82*a*, 83*a* are arranged and spaced on rolling cone cutter 1 so as not to interfere with rows of inner row cutter elements on the other cone cutters 2, 3. Cone 1 is further provided with relatively small "ridge cutter" cutter elements 84 in nose region 42 which tend to prevent formation build-up between the cutting paths followed by adjacent rows of the more aggressive, primary inner row cutter elements from different cone cutters. Cone cutters 2 and 3 have heel, gage and inner row cutter elements and ridge cutters that are similarly, although not identically, arranged as compared to cone 1. The arrangement of cutter elements differs as between the three cones in order to maximize borehole bottom coverage, and also to provide clearance for the cutter elements on the adjacent cone cutters.

In the embodiment shown, inserts 60, 70, 80-83 each includes a generally cylindrical base portion, a central axis, and a cutting portion that extends from the base portion, and further includes a cutting surface for cutting the formation material. The base portion is secured by interference fit into a mating socket drilled into the surface of the cone cutter.

A cutter element 100 is shown in FIGS. 3-6 and is believed to have particular utility when employed as an inner row cutter element, such as in inner rows 81*a* or 82*a* shown in FIGS. 1 and 2 above. However, cutter element 100 may also be employed in other rows and other regions on the cone cutter, such as in heel row 60*a* and gage rows 70*a*, 70*b* shown in FIGS. 1 and 2.

Figure 3:
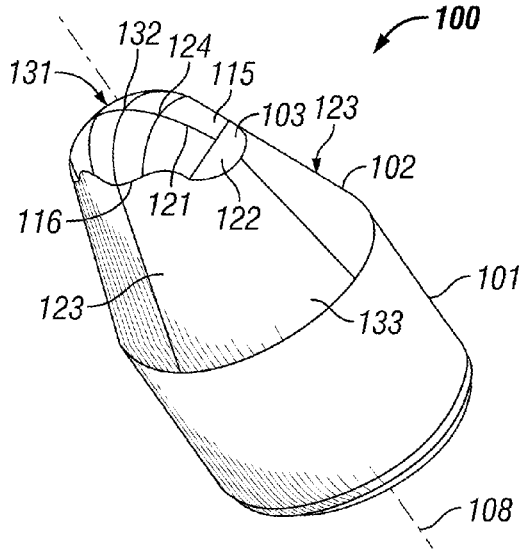
FIG. 3 is a perspective view of an embodiment of a cutter element having particular application in a rolling cone bit such as that shown in FIGS. 1 and 2.
Figure 4:
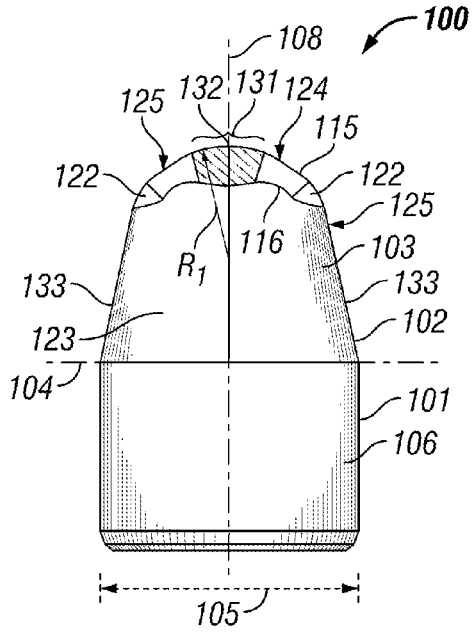
FIG. 4 is a front elevation view of the cutter element shown in FIG. 3.
Figure 5:
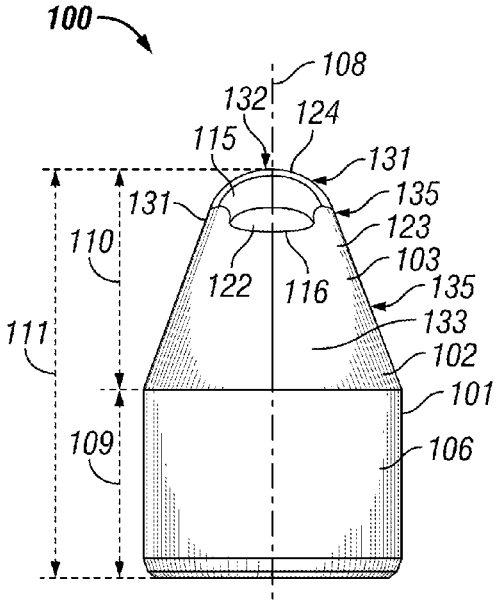
FIG. 5 is a side elevation view of the cutter element shown in FIG. 3.
Figure 6:
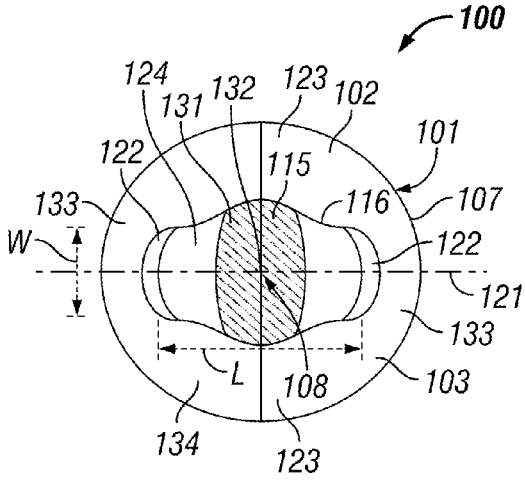
FIG. 6 is a top view of the cutter element shown in FIG. 3.

Referring now to FIGS. 3-6, cutter element or insert 100 is shown to include a base portion 101 and a cutting portion 102 extending therefrom. Cutting portion 102 includes a cutting surface 103 extending from a reference plane of intersection 104 that divides base 101 and cutting portion 102 (FIG. 4). In this embodiment, base portion 101 is generally cylindrical, having diameter 105, central axis 108, and an outer surface 106 defining an outer circular profile or footprint 107 of the insert (FIG. 6). As best shown in FIG. 5, base portion 101 has a height 109, and cutting portion 102 extends from base portion 101 so as to have an extension height 110. Collectively, base 101 and cutting portion 102 define the insert's overall height 111. Base portion 101 may be formed in a variety of shapes other than cylindrical. As conventional in the art, base portion 101 is preferably retained within a rolling cone cutter by interference fit, or by other means, such as brazing or welding, such that cutting portion 102 and cutting surface 103 extend beyond the cone steel. Once mounted, the extension height 110 of the cutter element 100 is generally the distance from the cone surface to the outermost point or portion of cutting surface 103 as measured perpendicular to the cone surface and generally parallel to the insert's axis 108.

Referring still to FIGS. 3-6, cutting portion 102 comprises a pair of flanking surfaces 123 and a pair of lateral side surfaces 133. Flanking surfaces 123 generally taper or incline towards one another to form an elongate chisel crest 115 that extends between crest ends or corners 122. As used herein, the term "elongate" may be used to describe an insert crest whose length is greater than its width. In this embodiment, crest ends 122 are partial spheres, each defined by spherical radii. Although crest ends 122 are shown with identical spherical radii in this embodiment, in other embodiments, the crest ends need not be spherical and may not be of uniform size.

Lateral side surfaces 133 extend from base portion 101 to crest 115. More specifically lateral side surfaces 133 extend from base portion 101 to crest ends 122, and generally extend between flanking surfaces 123. Side surfaces 133 are generally frustoconical as they extend from base portion 101 toward crest ends 122. In addition, side surfaces 133 are blended into flanking surfaces 123 and crest corners 122. Specifically, in this embodiment, relatively smooth transition surfaces are provided between flanking surfaces 123, side surfaces 133, and crest 115 such that cutting surface 103 is continuously contoured. As used herein, the term "continuously contoured" may be used to describe surfaces that are smoothly curved so as to be free of sharp edges and transitions having small radii (0.04 in. or less) as have conventionally been used to break sharp edges or round off transitions between adjacent distinct surfaces.

Referring to the front and side views of FIGS. 4 and 5, respectively, side surfaces 133 and crest 115 define a front periphery or profile 125 of insert 100 (FIG. 4); while flanking surfaces 123 and crest 115 define a side periphery or profile 135 of insert 100 (FIG. 5). It is to be understood that in general, the term "profile" may be used to refer to the shape and geometry of the outer periphery of an insert when viewed substantially perpendicular to the insert's axis. The "front profile" of an insert reveals the insert's profile in a front, while the "side profile" of an insert reveals the insert's profile and geometry in side view. In contrast, an "axial view" of an insert is a view of the insert taken along the insert's axis. The "top axial view" of an insert is a view, taken along the insert's axis, looking down on the top of the insert.

As seen in front profile 125 (FIG. 4), lateral side surfaces 133 are generally straight in the region between base portion 101 and crest 115. Likewise, as seen in side profile 135 (FIG. 5), flanking surfaces 123 are generally straight in the region between base portion 101 and crest 115. Consequently, lateral side surfaces 133 and flanking surfaces 123 each have a substantially constant radius of curvature in the region between base portion 101 and crest 115 as seen in the front and side profiles 125, 135, respectively. It is to be understood that a straight line, as well as a flat or planar surface, has a constant radius of curvature of infinity. Although flanking surfaces 123 and side surfaces 133 of the embodiment shown in FIGS. 3-6 are substantially straight in the region between base portion 101 and crest 115 as illustrated in profiles 135, 125, respectively, in other embodiments, the flanking surfaces (e.g., flanking surfaces 123) and/or the side surfaces (e.g., side surfaces 133) may be curved or arcuate between the base portion (e.g., base portion 101) and the crest (e.g., crest 115).

As previously described, in profiles 135, 125, flanking surfaces 123 and side surfaces 133, respectively, are substantially straight, each having a constant radius of curvature in the region between base portion 101 and crest 115. The transition from surfaces 123, 133 to crest 115 generally occurs where the substantially straight surfaces 133, 123 begin to curve in profiles 125, 135, respectively. In other words, the points in profiles 135, 125 at which the radius of constant curvature of surfaces 123, 133, respectively, begin to change marks the transition into crest 115. The points at which the radius of curvature of surfaces 123, 133 begin to change is denoted by a parting line 116. Thus, parting line 116 may be used to schematically define crest 115 of insert 100.

Referring specifically to FIGS. 3 and 6, elongate chisel crest 115 extends between crest ends or corners 122, and comprises a peaked ridge 124, an apex 132, and a cutting tip 131. In top axial view (FIG. 6), peaked ridge 124 in this embodiment extends substantially linearly between crest corners 122 along a crest median line 121. Likewise in this embodiment, flanking surfaces 123 are symmetric about crest median line 121, each flanking surface 123 being a mirror images of the other across median line 121 in top view (FIG.

6). Crest 115 and peaked ridge 124 each have a length L measured along cutting surface 103 between crest ends 122. Further, crest 115 has a width W measured perpendicular to crest median line 121 in top axial view along cutting surface 103 between flanking surfaces 123 (FIG. 6). It should be appreciated that the width W of crest 115 is not constant, but rather, varies along its length L. Specifically, width W of crest 115 generally decreases towards crest ends 122, and is widest at apex 132.

Apex 132 represents the uppermost point of cutting surface 103 and crest 115 at extension height 110. As used herein, the term "apex" may be used to refer to the point, line, or surface of an insert disposed at the extension height of the insert.

Cutting tip 131 is generally the portion of crest 115 immediately surrounding apex 132. For purposes of clarity and further explanation, cutting tip 131 is shown shaded in FIGS. 4 and 6. In this particular embodiment, cutting tip 131 of crest 115 represents about 40% of the length L of crest 115, and is centered about apex 132. Since apex 132 is positioned at the center of crest 115 in this embodiment, cutting tip 131 represents the middle 40% of crest 115. Cutting tip 131 in this example may also be described as extending from about 20% of length L to either side of apex 132. It should be appreciated that although cutting tip 131 has been described above as extending 20% of the length L of crest 115 to either side of apex 132, in general, the cutting tip of an insert (e.g., cutting tip 131) defines that portion of the crest (e.g., crest 115) that immediately surrounds and is proximal the apex of the insert (e.g., apex 132). In addition, in this embodiment, cutting tip 131 is integral with crest 115 and is smoothly blended with the remainder of crest 115.

Referring specifically to front profile 125 (FIG. 4), in this embodiment, crest 115 and peaked ridge 124 are smoothly curved along their length L between crest ends 122. Specifically, crest 115 and peaked ridge 124 are convex or bowed outward along their length, and further, have a substantially constant longitudinal radius of curvature $R_1$ between crest corners 122. As used herein, the phrase "longitudinal radius of curvature" may be used to refer to the radius of curvature of a surface along its length. Thus, contrary to many conventional chisel-shaped inserts that have a flat or substantially flat crest in front profile view, crest 115 and peaked ridge 124 of insert 100 are rounded or curved along their lengths.

Referring now to side profile 135 (FIG. 5), in this embodiment, crest 115 is also curved along its side profile 135 between flanking surfaces 123. Specifically, crest 115 is convex or bowed outward between flanking surfaces 123. As will be explained in more detail below, the radius of curvature of crest 115 between flanking surfaces 123 in side profile 135 varies along peaked ridge 124. Thus, crest 115, as well as cutting tip 131, may be described as being curved in two dimensions—convex between crest corners 122 in front profile 125 (FIG. 4), and convex between flanking surfaces 123 in side profile 135 (FIG. 5).

Since crest 115 is convex as seen in front profile 125 (FIG. 4) and side profile 135 (FIG. 5), cutting tip 131 has a rounded or domed geometry and surface. When insert 100 engages the uncut formation, cutting tip 131, at least initially, presents a reduced surface area region or projection that contacts the formation. Consequently, cutting tip 131 offers the potential to enhance formation penetration of insert 100 since the weight applied to the formation through insert 100 is concentrated, at least initially, on the relatively small surface area of cutting tip 131. In this sense, rounded cutting tip 131 may be described as enhancing the sharpness or aggressiveness of insert 100.

Figure 7:
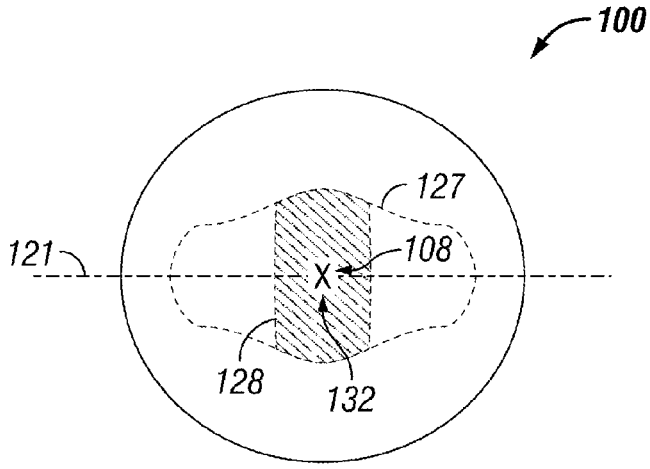
FIG. 7 is a schematic top view of the cutter element shown in FIGS. 3-6.

Referring now to FIG. 7, a top view of insert 100 like that shown in FIG. 6 is shown, however, in FIG. 7, dashed lines 127, 128 schematically represents what is referred to herein as the top profile of crest 115 and cutting tip 131, respectively. Dashed line 127 represents the elongate shape corresponding to the top profile of crest 115, and dashed line 128 represents the general shape corresponding to the top profile of cutting tip 131. For purposes of clarity and further explanation, cutting tip 131 of crest 115 is shown shaded in FIG. 7. Similar to parting line 116 described above, dashed line 127 is generally shown at the transition between surfaces 123, 133 and crest 115. In this embodiment, the location of apex 132 is denoted by an "X" since apex 132 is essentially a point on cutting surface 103 and cutting tip 131 at extension height 110.

Comparing dashed lines 127, 128, and insert axis 108, apex 132 and cutting tip 131 are generally positioned in the center of crest 115 in the embodiment shown in FIG. 7. Thus, apex 132 and cutting tip 131 are each equidistant from crest ends 122. Further, in this embodiment, apex 132, cutting tip 131, and crest 115 are centered relative to insert axis 108. In other words, insert axis 108 intersects apex 132 and passes through the center of cutting tip 131 and crest 115. As will be explained in more detail below, in other embodiments, the apex and/or the cutting tip may be positioned closer to one of the crest ends (i.e., not centered about the crest ends), and further, the crest, apex, or the cutting tip may be offset from the insert axis.

Figure 8:
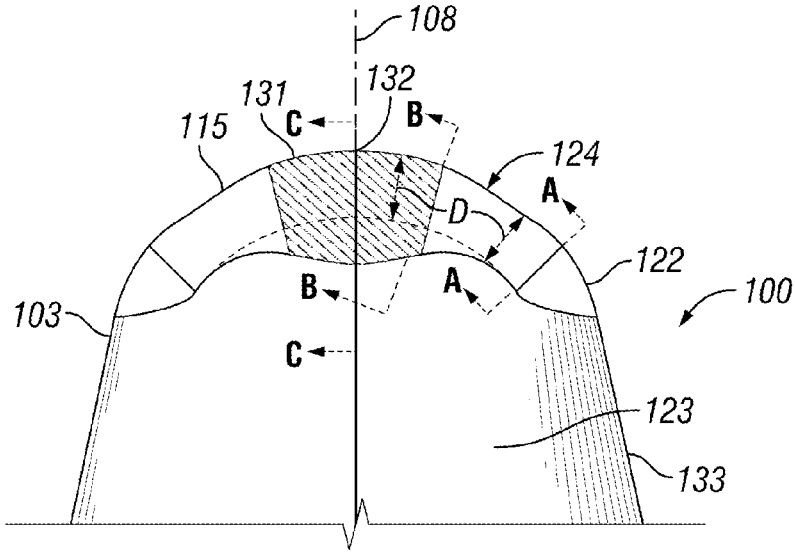
FIG. 8 is an enlarged partial front elevation view of the cutter element shown in FIG. 3.
Figure 9:
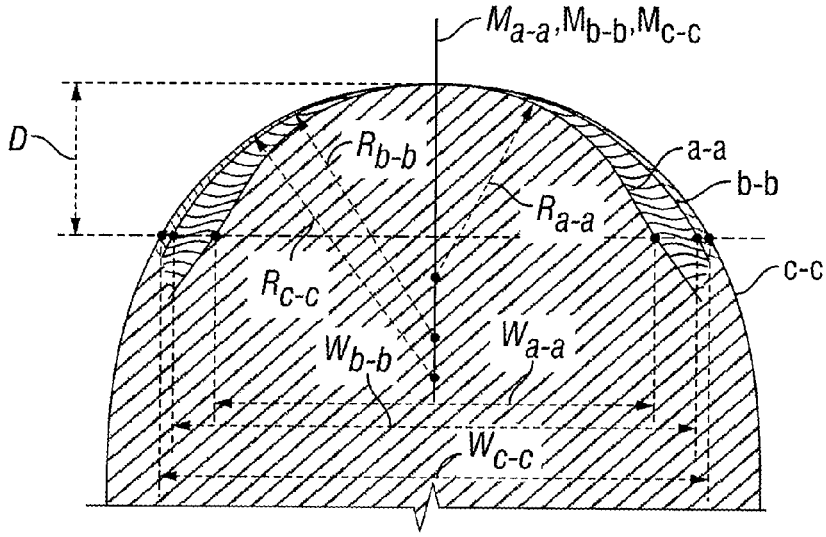
FIG. 9 is an enlarged superimposed view of the cross-sections of the crest of the cutter element shown in FIG. 8 taken along lines A-A, B-B, and C-C.

Referring now to FIGS. 8 and 9, particular cross-sectional views of crest 115 are illustrated. Specifically, in FIG. 9, transverse cross-sections a-a, b-b, and c-c of crest 115, taken along lines A-A, B-B, and C-C of FIG. 8, respectively, are shown superimposed on one another. For comparison and clarity purposes, transverse cross-sections a-a, b-b, and c-c are shown with their uppermost surfaces or peaks aligned. Cross-sectional lines A-A, B-B, and C-C are substantially perpendicular to cutting surface 103 of crest 115 at selected spots along peaked ridge 124. Consequently, each transverse cross-section a-a, b-b, c-c represents a cross-section of crest 115 taken perpendicular to cutting surface 103 of crest 115. Thus, as used herein, the phrase "transverse cross-section" may be used to describe a cross-section of an elongate crest (e.g., chisel-shaped crest) taken perpendicular to the peaked ridge of the crest at a given point along the length of the crest.

Referring still to FIGS. 8 and 9, transverse cross-section a-a of crest 115 is taken between cutting tip 131 and crest corner 122 generally proximal crest corner 122. Transverse cross-section b-b of crest 115 is taken between crest corner 122 and apex 132, generally proximal the transition into cutting tip 131. Lastly, transverse cross-section c-c of crest 115 is taken within cutting tip 131, and more specifically, at apex 132. It should be appreciated that although only three transverse cross-sections a-a, b-b, c-c are illustrated in FIG. 9, in general, transverse cross-sections of an elongate crest (e.g., crest 115) may be taken at an infinite number of points along the peaked ridge of an elongate crest.

Referring specifically to FIG. 9, in this embodiment, transverse cross-sections a-a, b-b, c-c of crest 115 are substantially symmetric about a transverse cross-section median line $M_{a-a}$, $M_{b-b}$, $M_{c-c}$, respectively. In other words, median lines $M_{a-a}$, $M_{b-b}$, $M_{c-c}$ generally divide transverse cross-sections a-a, b-b, c-c, respectively, into substantially equal halves. For comparison and clarity purposes, transverse cross-sections a-a, b-b, c-c are shown aligned in FIG. 9 such that transverse cross-section median lines $M_{a-a}$, $M_{b-b}$, $M_{c-c}$, are aligned. It should be appreciated that transverse cross-sections a-a, b-b, c-c of crest 115 each have slightly different geometries (e.g., different shapes, different sizes, etc.). The geometry of each transverse cross-section a-a, b-b, c-c of crest 115 may be described, at least in part, in terms of a transverse radius of curvature $R_{a-a}$, $R_{b-b}$, $R_{c-c}$, respectively. As used herein, the phrase "transverse radius of curvature" may be used to refer to the radius of curvature of a transverse cross-section of a crest. Thus, the "transverse radius of curvature" of a crest is the radius of curvature of the cutting surface of the crest when viewed in transverse cross-section. In this embodiment, transverse radius of curvature $R_{a-a}$ of cross-section a-a is constant, transverse radius of curvature $R_{b-b}$ of cross-section b-b is constant, and transverse radius of curvature $R_{c-c}$ of cross-section c-c is constant. However, in other embodiments, a particular transverse cross-section may have a variable transverse radius of curvature (i.e., the transverse radius of curvature of a select transverse cross-section is non-uniform).

Referring still to FIG. 9, in this embodiment, transverse radius of curvature $R_{a-a}$ is smaller than transverse radius of curvature $R_{b-b}$. Further, transverse radius of curvature $R_{b-b}$ is smaller than transverse radius of curvature $R_{c-c}$. In particular, the transverse radius of curvature of crest 115 is at a minimum proximal crest corners 122, and generally increases towards apex 132. At apex 132 the transverse radius of curvature of crest 115 (i.e., transverse radius of curvature $R_{c-c}$) reaches a maximum. In other words, crest 115 may be described as having a transverse radius of curvature that increases moving from each crest end 122 toward apex 132. Thus, the transverse radius of curvature of crest 115 is greater within cutting tip 131 than outside cutting tip 131.

The transverse radius of curvature at the apex of the crest is preferably at least 5% larger than the transverse radius of curvature at either of the crest ends, and more preferably at least 10% larger than the transverse radius of curvature at either of the crest ends. In some embodiments, the transverse radius of curvature at the apex of the crest is preferably at least 20% larger than the transverse radius of curvature at either the crest ends. In the exemplary embodiment shown in FIG. 9, transverse radius of curvature $R_{a-a}$ is about 0.110 in., transverse radius of curvature $R_{b-b}$ is about 0.140 in., and transverse radius of curvature $R_{c-c}$ is about 0.160 in. Thus, in this embodiment, the transverse radius of curvature $R_{c-c}$ at apex 132 is about 45% larger than the transverse radius of curvature $R_{a-a}$ proximal crest corner 122.

The geometry of each transverse cross-section a-a, b-b, c-c may also be described, at least in part, in terms of a transverse width $W_{a-a}$, $W_{b-b}$, $W_{c-c}$, respectively. For comparison purposes, each transverse width $W_{a-a}$, $W_{b-b}$, $W_{c-c}$ is measured at the same depth D from, and perpendicular to, the upper surface of crest 115 (i.e., at same depth D from peaked ridge 124). As used herein, the phrase "transverse width" may be used to refer to the width of a transverse cross-section of a crest at a given depth from, and perpendicular to, the upper surface of the crest. In this embodiment, the ratio of depth D to extension height 110 of insert 100 is about 0.10 (or 10%). Although the transverse width of an elongate crest may be measured at any suitable depth D, since the transverse width of a crest is intended to be a measure of the geometry of the crest (as opposed to other regions of the insert), the transverse width is preferably measured at a depth D that is within the crest. Thus, depth D is preferably between 5% and 20% of the extension height of the insert. It should be appreciated that for the comparison of two or more transverse widths taken at different points along the crest, each transverse width is preferably measured at a consistent uniform depth D.

Referring still to FIG. 9, transverse width $W_{a-a}$ is less than transverse width $W_{b-b}$. Further, transverse width $W_{b-b}$ is less than transverse width $W_{c-c}$. In particular, the transverse width of crest 115 is at a minimum proximal crest corners 122, and generally increases towards apex 132. At apex 132 the transverse width of crest 115 (i.e., transverse width $W_{c-c}$) reaches a maximum. In other words, crest 115 may be described as having a transverse width that increases moving from each crest end 122 toward apex 132. Thus, the transverse width of crest 115 is greater within cutting tip 131 than outside cutting tip 131.

The transverse width at the apex is preferably at least 5% larger than the transverse width at either of the crest ends, and more preferably at least 10% larger than the transverse width at either of the crest ends. In some cases, the transverse width is preferably at least 20% larger than the transverse width at either of the crest ends. In the exemplary embodiment shown in FIG. 9, transverse width $W_{a-a}$ is about 0.193 in., transverse width $W_{b-b}$ is about 0.233 in., and transverse width $W_{c-c}$ is about 0.245 in. Thus, in this embodiment, the transverse width $W_{c-c}$ at apex 132 is about 27% larger than the transverse width $W_{a-a}$ proximal crest corner 122.

As described above, the transverse cross-sections of crest 115 taken at different points along peaked ridge 124 have different geometries. In general, moving along peaked ridge 124 from either crest corner 122 toward apex 132, the transverse radius of curvature and the transverse width of crest 115 generally increase, both reaching maximums at apex 132. To the contrary, in many conventional chisel-shaped inserts, the transverse cross-section through any portion of the crest will have substantially the same or uniform geometry. The increased transverse radius of curvature and the increased transverse width of crest 115 proximal apex 132 within cutting tip 131, results in an increased volume of insert material proximal apex 132 within cutting tip 131. Since insert 100 will likely experience the greatest stresses proximal apex 132 within cutting tip 131 because the weight applied to the formation through insert 100 is concentrated, at least initially, on the relatively small surface area of cutting tip 131 proximal apex 132, the added insert material in these particular regions of crest 115 offer the potential for a stronger, more robust chisel-shaped insert 100.

As previously described, many conventional conical-shaped inserts have a cutting surface that tapers from a cylindrical base to a generally rounded or spherical tip. As a result, many such conical inserts have particular utility in relatively hard formations as the weight applied to the formation through the insert is concentrated, at least initially, on the relatively small surface area of the tip. However, because of the conical insert's relatively narrow profile, in softer formations, it is not able to remove formation material as quickly as would an insert having a wider cutting profile. On the other hand, many conventional chisel-shaped inserts having an elongate crest are equipped to remove formation material at a relatively fast rate as compared to a conical insert, but also tend to be more susceptible to chipping and fracturing since chisel crests generally include sharp cutting edges that endure high stresses, especially in harder formations.

Embodiments of insert 100 include an elongate radial crest 115 including a domed or rounded cutting tip 131 proximal apex 132. Similar to a conventional chisel-shaped insert, elongate chisel-crest 115 of insert 100 offers the potential for an increased rate of formation removal as compared to a conventional conical insert. Further, similar to a conventional conical insert, cutting tip 131 and apex 132 of elongate crest 115 offer the potential to enhance formation penetration as compared to conventional chisel-shaped inserts since the weight applied to the formation through insert 100 is concentrated, at least initially, on the relatively small surface area of rounded cutting tip 131.

Figure 10:
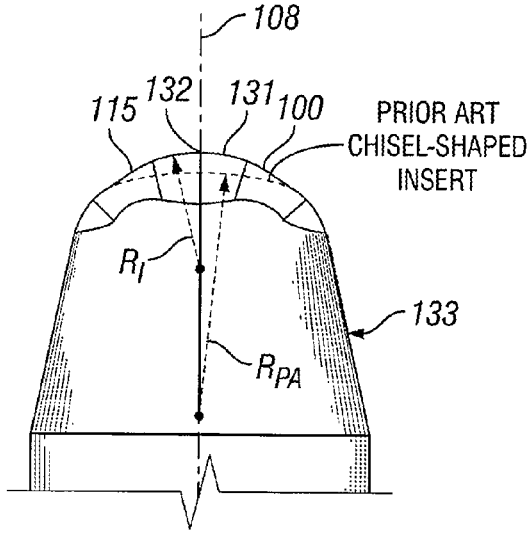
FIG. 10 is an enlarged partial front elevation view of a conventional prior art chisel-shaped insert superimposed on the cutter element of FIG. 3.
Figure 11:
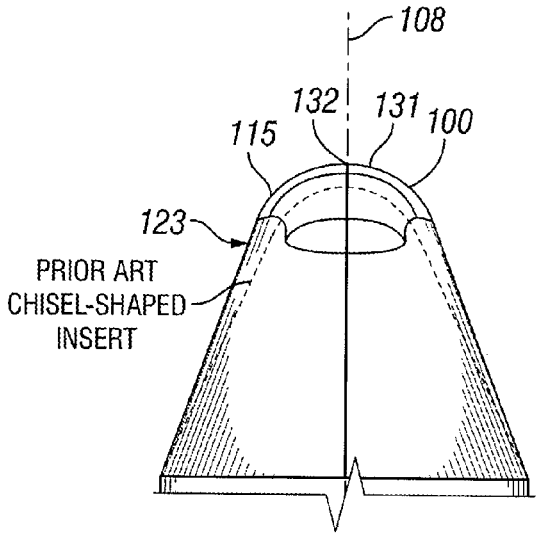
FIG. 11 is an enlarged partial side elevation view of the conventional prior art chisel-shaped insert of FIG. 10 superimposed on the cutter element of FIG. 3.

Referring now to FIGS. 10 and 11, one conventional prior art chisel-shaped insert (shown in a bold line profile) having a similar diameter as insert 100 (e.g., having the same diameter as diameter 105) is superimposed on insert 100 previously described for comparison purposes. Both insert 100 and the prior art chisel-shaped insert include an elongate crest. However, crest 115 of insert 100 has a greater extension height than the prior art chisel-shaped insert, and further, crest 115 of insert 100 has a smaller longitudinal radius of curvature $R_1$ than the prior art chisel-shaped insert (FIG. 10). As a result, crest 115 offers the potential for increased formation penetration depth as compared to the prior art chisel-shaped insert. In addition, unlike the prior art chisel-shaped insert, crest 115 of insert 100 has a variable transverse radius of curvature, and a variable transverse width, along peaked ridge 124. Specifically, as described above, the transverse radius of curvature and the transverse width of crest 115 increase towards apex 132. Thus, the enhanced "sharpness" of insert 100 resulting from an increased extension height and reduced longitudinal radius of curvature is supported and buttressed by additional insert material, particularly in cutting tip 131. Weakness and/or susceptibility to chipping or breakage resulting from the increase in extension height and reduced longitudinal radius of curvature are intended to be offset by the added strength and support provided by the greater volume of insert material in cutting tip 131. Specifically, the increased transverse radius of curvature and increased transverse width in cutting tip 131 and at apex 132 of crest 115 are intended to provide increased strength and support to cutting tip 131 and apex 132, which, at least initially, will tend to experience the greatest stress concentrations when the insert engages the uncut formation.

As previously described, cutting surface 103 is preferably continuously contoured. In particular, cutting surface includes transition surfaces between crest 115, flanking surfaces 123, and lateral side surfaces 133 to reduce detrimental stresses. Although certain reference or contour lines are shown in FIGS. 3-6 to represent general transitions between one surface and another, it should be understood that the lines do not represent sharp transitions. Instead, all surfaces are preferably blended together to form the preferred continuously contoured surface and cutting profiles that are free from abrupt changes in radius. By eliminating small radii along cutting surface 103, detrimental stresses in cutting surface 103 are reduced, leading to a more durable and longer lasting cutter element.

Figure 12:
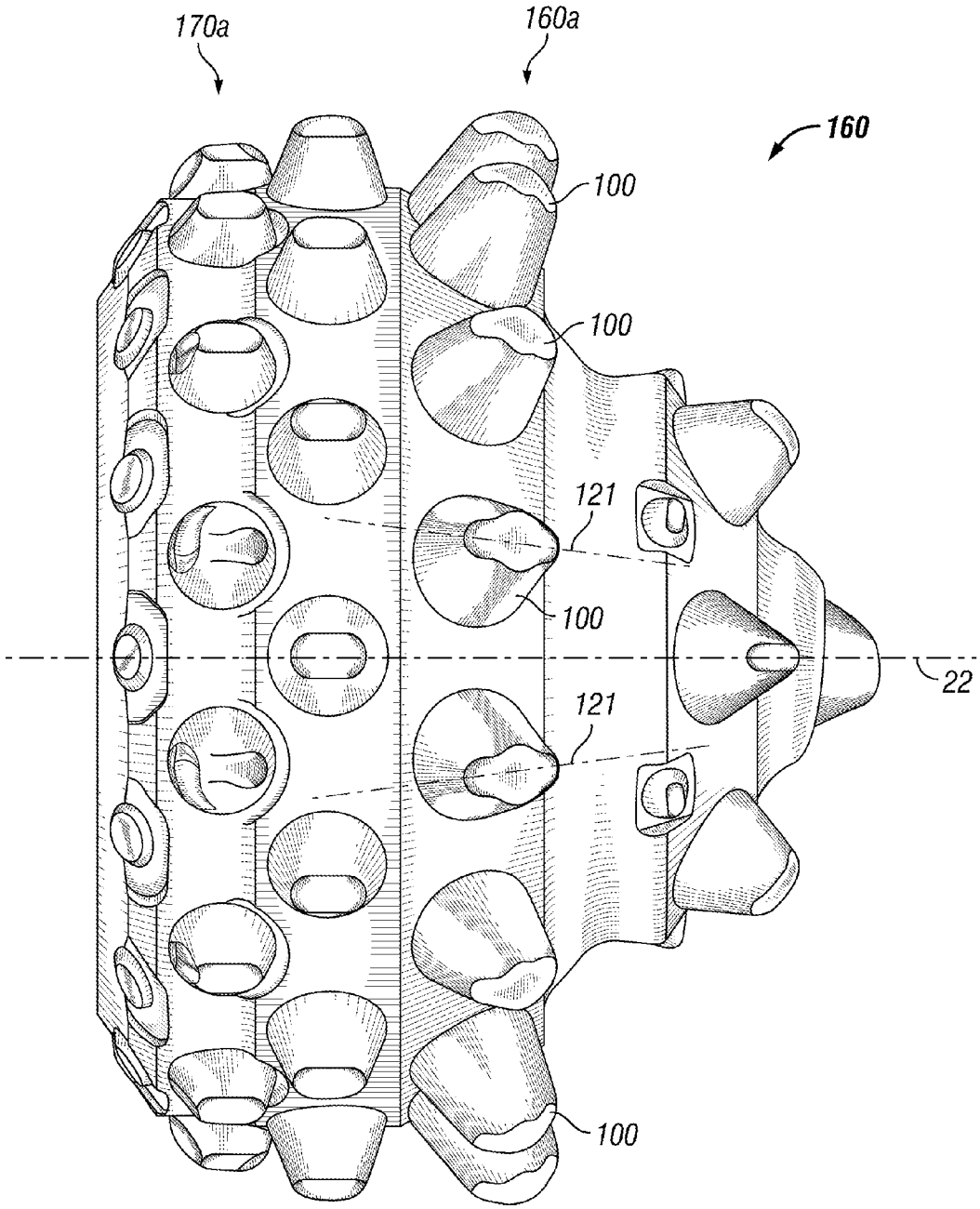
FIG. 12 is a perspective view of a rolling cone cutter having the cutter element of FIGS. 3-6 mounted therein.

Referring now to FIG. 12, insert 100 described above is shown mounted in a rolling cone cutter 160 as may be employed, for example, in bit 10 described above with reference to FIGS. 1 and 2, with cone cutter 160 substituted for any of the cones 1-3 previously described. As shown, cone cutter 160 includes a plurality of inserts 100 disposed in a circumferential inner row 160*a*. In this embodiment, inserts 100 are all oriented such that a projection of crest median line 121 is aligned with cone axis 22. Inserts 100 may be positioned in rows of cone cutter 160 in addition to or other than inner row 160*a*, such as in gage row 170*a*. Likewise, inserts 100 may be mounted in other orientations, such as in an orientation where a projection of the crest median line 121 of one or more inserts 100 is skewed relative to the cone axis.

As understood by those in the art, the phenomenon by which formation material is removed by the impacts of cutter elements is extremely complex. The geometry and orientation of the cutter elements, the design of the rolling cone cutters, the type of formation being drilled, as well as other factors, all play a role in how the formation material is removed and the rate that the material is removed (i.e., ROP).

Depending upon their location in the rolling cone cutter, cutter elements have different cutting trajectories as the cone rotates in the borehole. Cutter elements in certain locations of the cone cutter have more than one cutting mode. In addition to a scraping or gouging motion, some cutter elements include a twisting motion as they enter into and then separate from the formation. As such, cutting elements 100 may be oriented to optimize the cutting and formation removal that takes place as the cutter element both scrapes and twists against the formation. Furthermore, as mentioned above, the type of formation material dramatically impacts a given bit's ROP. In relatively brittle formations, a given impact by a particular cutter element may remove more rock material than it would in a less brittle or a plastic formation.

The impact of a cutter element with the borehole bottom will typically remove a first volume of formation material and, in addition, will tend to cause cracks to form in the formation immediately below the material that has been removed. These cracks, in turn, allow for the easier removal of the now-fractured material by the impact from other cutter elements on the bit that subsequently impact the formation. Without being limited to this or any other particular theory, it is believed that insert 100 having an elongate crest 115 including a rounded or domed cutting tip 131, as described above, will enhance formation removal by propagating cracks further into the uncut formation than would be the case for a conventional chisel-shaped insert of similar size. Further, it is believed that providing an a generally elongate crest 115 enhances formation removal by providing a greater total crest length as compared to most conventional conical inserts. In particular, it is anticipated that providing rounded or domed cutting tip 131 at apex 132 with its relatively small surface area will provide insert 100 with the ability to penetrate deeply without the requirement of adding substantial additional weight-on-bit to achieve that penetration. Cutting tip 131 leads insert 100 into the formation and initiates the penetration of insert 100. As cutting tip 131 penetrates the rock, it is anticipated that substantial cracking of the formation will have occurred, allowing the remainder of elongate crest 115 to gouge and scrape away a substantial volume of formation material as crest 115 sweeps across (and in some cone positions, twists through) the formation material. Further, since cutting tip 131 has a greater extension height, and is thus able to extend deeper into the formation as compared to a similarly-sized conventional chisel-shaped insert, it is believed that insert 100 will create deeper cracks into a localized area, allowing the remainder of insert 100, and the cutter elements that follow thereafter, to remove formation material at a faster rate. However, as previously described, the increased extension height and reduced longitudinal radius of curvature of crest 115 are accompanied by an increased transverse radius of curvature and transverse width in cutting tip 131 and particularly at apex 132. Consequently, the increased "sharpness" and penetrating potential of insert 100 is buttressed and supported by increased insert material, especially in those portions of crest 115 that will tend to experience the greatest stresses—cutting tip 131 and apex 132.

Although the embodiment of insert 100 shown in FIGS. 3-6 includes a convex elongate crest 115 having a substantially constant longitudinal radius of curvature $R_1$ between crest ends 122, alternative embodiments made in accordance with the principles described herein are not limited to convex and uniformly curved crests. However, similar to insert 100 previously described, such alternative embodiments preferably include an elongate crest having a cutting tip with an increased transverse width and an increased transverse radius of curvature.

Figure 13:
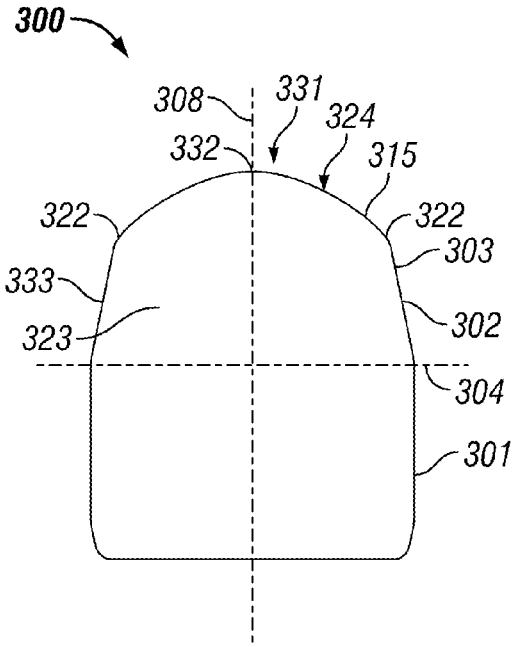
FIGS. 13-15 are front profile views of alternative cutter elements having particular application in a rolling cone bit, such as that shown in FIGS. 1 and 2.

Referring now to FIG. 13, the front profile of an insert 300 substantially the same as insert 100 previously described is shown. Insert 300 comprises a base portion 301, a cutting portion 302 extending therefrom, and has a central axis 308. Cutting portion 302 includes a cutting surface 303 extending from a reference plane of intersection 304 that divides base 301 and cutting portion 302.

Cutting portion 302 comprises a pair of flanking surfaces 323 and a pair of lateral side surfaces 333. Flanking surfaces 323 generally taper or incline towards one another to form an elongate chisel crest 315 that extends between crest ends or corners 322. Lateral side surfaces 333 extend from base portion 301 to crest 315, and more specifically to crest ends 322.

Elongate chisel crest 315 extends between crest ends or corners 322, and comprises an apex 332, a cutting tip 331 immediately surrounding apex 332, and lateral crest portions 324 extending between cutting tip 331 and corners 322. Cutting tip 331 and crest portions 324 are integral and are preferably smoothly blended to form crest 315.

Like insert 100 previously described, the transverse radius of curvature and transverse width of crest 315 generally increase moving from either crest corner 322 toward apex 332. In particular, the transverse radius of curvature and the transverse width of crest 315 reach maximums at apex 332. Further, also similar to insert 100, in this embodiment, crest 315 is generally convex or bowed outward along its length. Namely, cutting tip 331 and crest portions 324 are each convex or bowed outward. However, unlike insert 100 previously described, crest 315 of insert 300 does not have a constant longitudinal radius of curvature along its length between crest ends 322. Rather, cutting tip 331 has longitudinal radius of curvature that differs from the longitudinal radius of curvature of crest portions 324. More specifically, cutting tip 331 has a smaller longitudinal radius of curvature than crest portions 324.

Figure 14:
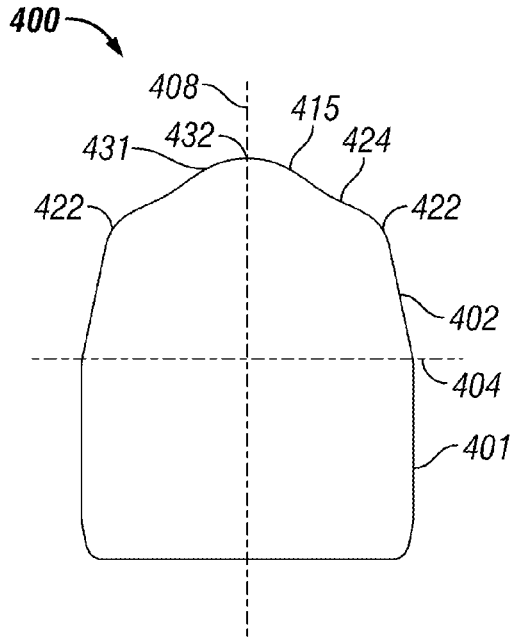

Referring now to FIG. 14, the front profile of an insert 400 substantially the same as insert 100 previously described is shown. Insert 400 has a central axis 408, and comprises a base portion 401 and a cutting portion 402 extending therefrom. Cutting portion 402 includes an elongate chisel crest 415 that extends between crest ends or corners 422. Elongate chisel crest 415 comprises an apex 432, a cutting tip 431 immediately surrounding apex 432, and lateral crest portions 424 extending between cutting tip 431 and corners 422. Cutting tip 431 and crest portions 424 are integral and are preferably smoothly blended to form crest 415.

Like insert 100 previously described, the transverse radius of curvature and the transverse width of crest 415 generally increase moving from crest corner 422 toward apex 432. In particular, the transverse radius of curvature and the transverse width of crest 415 are greatest at apex 432. Further, also similar to insert 100, in this embodiment, cutting tip 431 is convex and has a rounded or domed geometry. However, unlike insert 100 previously described, crest 415 of insert 400 does not have a constant longitudinal radius of curvature along its length between crest ends 422. And further, unlike insert 100, crest 415 of insert 400 is not convex along its entire length. Rather, cutting tip 431 has longitudinal radius of curvature that differs from the longitudinal radius of curvature of crest portions 424. In addition, although cutting tip 431 is generally convex, crest portions 424 between corners 422 and cutting tip 431 are concave or bowed inward, and thus, may be described as having an inverted radius of curvature.

Figure 15:
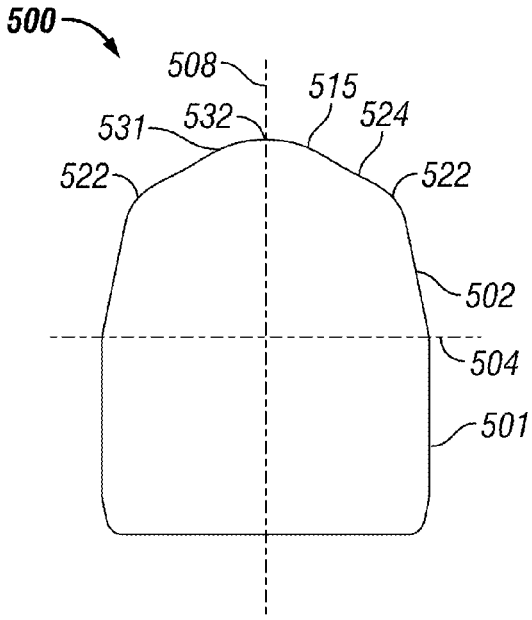

Referring now to FIG. 15, the front profile of an insert 500 substantially the same as insert 100 previously described is shown. Insert 500 has a central axis 508 and comprises a base portion 501 and a cutting portion 502 extending therefrom. Cutting portion 502 includes an elongate chisel crest 515 that extends between crest ends or corners 522. Elongate chisel crest 515 comprises an apex 532, a cutting tip 531 immediately surrounding apex 532, and lateral crest portions 524 between cutting tip 531 and corners 522.

Like insert 100 previously described, the transverse radius of curvature and transverse width of crest 515 generally increase towards apex 532. In particular, the transverse radius of curvature and the transverse width of crest 515 are greatest at apex 532. Further, also similar to insert 100, in this embodiment, cutting tip 531 is convex and has a domed geometry. However, unlike insert 100 previously described, crest 515 of insert 500 does not have a constant longitudinal radius of curvature along its length between crest ends 522, and further, crest 515 is not convex along its entire length. Rather, cutting tip 531 has longitudinal radius of curvature that differs from the longitudinal radius of curvature of crest portions 524. In addition, although cutting tip 531 is generally convex, crest portions 524 between corners 522 and cutting tip 531 are substantially straight.

Figure 16:
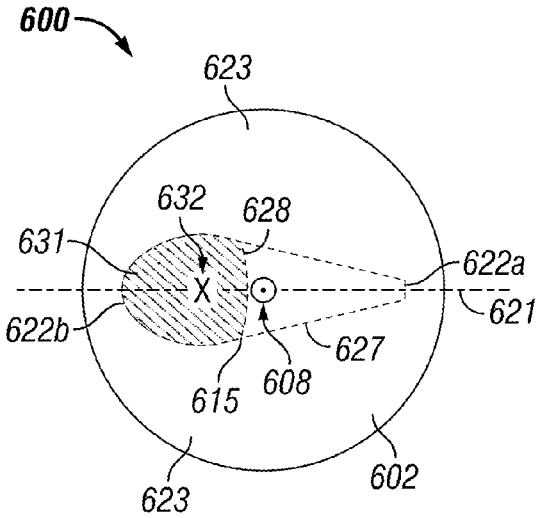
FIGS. 16-21 are schematic top views of alternative cutter elements having application in a rolling cone bit, such as that shown in FIGS. 1 and 2.

FIGS. 16-21 are similar to the view of FIG. 7, and show, in schematic fashion, alternative cutter elements made in accordance with the principles described herein. In particular, FIG. 16 shows a cutter element or insert 600 having an insert axis 608 and a cutting portion 602 including an elongate chisel crest 615 with a top profile 627, and a cutting tip 631 having a top profile 628. For purposes of clarity and further explanation, cutting tip 631 is shown shaded in FIG. 16. In addition, the apex 632 of insert 600 is denoted by an "X" in this embodiment since apex 632 is essentially a point on the cutting surface of insert 600 positioned within cutting tip 631.

Similar to cutter element 100 previously described, cutter element 600 includes an elongate crest 615 that extends linearly along a crest median line 621 between crest ends 622*a, b*. Crest median line 621 passes through insert axis 608. For use herein, such arrangement may be described as one in which the crest 615 has zero offset from the insert axis. Further, like insert 100, moving along crest 615 from either crest end 622*a, b* toward apex 632, the transverse radius of curvature and the transverse width of elongate crest 615 generally increase, reaching maximums at apex 632. However, in this embodiment, apex 632 and cutting tip 631 are not positioned at the center of crest 615. Rather, insert 600 includes diverging flanks 623 which extend from a relatively narrow crest end 622*a* to a relatively wider crest end 622*b*. Crest flanks 623 taper towards one another as they extend from the base of insert 600 towards the top of crest 615, and also diverge from one another as they extend from narrow crest end 622*a* to larger crest end 622*b*. In this example, each crest end 622*a, b* is generally spherical with a radius at end 622*b* larger than the radius of end 622*a*. In other embodiments, one or both crest ends (e.g., crest ends 622*a, b*) may have shapes other than spherical. In addition, apex 632 and cutting tip 631 are not centered about insert axis 608. Rather, apex 632 and cutting tip 631 are offset from insert axis 608 and generally positioned proximal crest ends 622*b* (the larger crest end) and distal crest end 622*a* (the smaller crest end). Thus, in this embodiment, apex 632 and cutting tip 631 are not equidistant from crest ends 622*a, b*.

In certain formations, and in certain positions in a rolling cone cutter, it is desirable to have a crest end (e.g., relatively larger crest end 622*b*) with a greater mass of insert material. The increased mass of insert material may be preferred for a variety of reasons including, without limitation, to improve wear resistance, to provide additional strength, to buttress a region of the insert especially susceptible to chipping, or combinations thereof. For example, insert 600 may be employed in a gage row, such as row 80*a* shown in FIGS. 1 and 2, with insert 600 positioned such that larger crest end 622*b* is closest to the borehole sidewall where abrasive wear is likely to be greatest.

Figure 17:
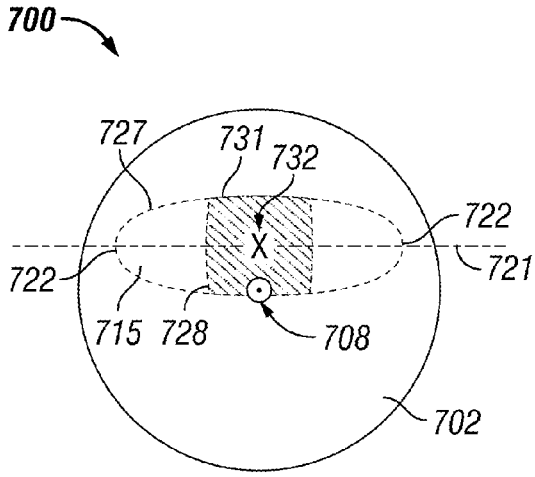

Referring now to FIG. 17, an insert 700 having an insert axis 708, a cutting portion 702, and an elongate crest 715 with a cutting tip 731 is illustrated in schematic fashion. Crest 715 has a top profile 727, and cutting tip 731 has a top profile 728. For purposes of clarity and further explanation, cutting tip 731 is shown shaded in FIG. 17. The apex 732 of crest 715 is denoted by an "X" in this embodiment since apex 732 is essentially a point on the cutting surface of insert 700 positioned in cutting tip 731.

In this embodiment, elongate crest 715 extends generally linearly along a crest median line 721 between crest ends 722. Comparing lines 727, 728, and insert axis 708, apex 732 and cutting tip 731 are positioned generally in the center of crest 715. Thus, apex 732 and cutting tip 732 are equidistant from crest ends 722. Further, as with insert 100 previously described, moving from either crest end 722 towards apex 732 along crest 715, the transverse radius of curvature and the transverse width of crest 715 generally increase, reaching maximums at apex 732. However, unlike insert 100 previously described, crest median line 721 is offset from insert axis 708. In other words, crest median line 721 does not intersect insert axis 708.

Figure 18:
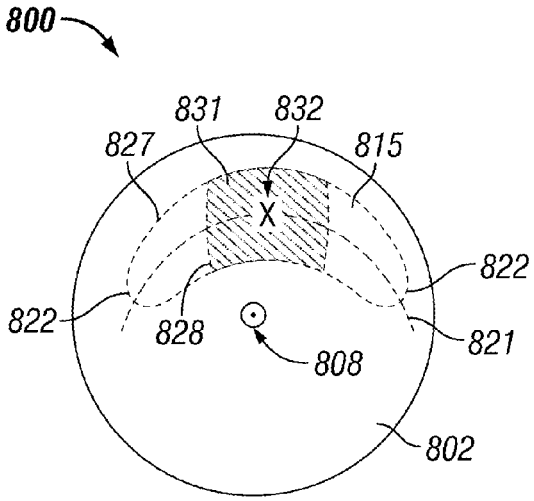

Referring now to FIG. 18, an insert 800 having an insert axis 808, a cutting portion 802, and an elongate crest 815 with a cutting tip 831 is illustrated in schematic fashion. Crest 815 has a top profile 827, and cutting tip 831 has a top profile 828. For purposes of clarity and further explanation, cutting tip 831 is shown shaded in FIG. 18. The apex 832 of crest 815 is denoted by an "X" in this embodiment since apex 832 is essentially a point on the cutting surface of insert 800 positioned in cutting tip 831.

Elongate arcuate crest 815 extends along a crest median line 821 between crest ends 822. Comparing lines 827, 828, and insert axis 808, apex 832 and cutting tip 831 are positioned generally in the middle of crest 815. Thus, apex 832 and cutting tip 831 are equidistant from crest ends 822. As with insert 100 previously described, moving from either crest end 822 toward apex 832 along elongate crest 815, the transverse radius of curvature and the transverse width of crest 815 generally increase, reaching maximums at apex 832. However, unlike insert 100 previously described, crest 815 and crest median line 821 are not straight in top axial view, but rather, are arcuate or curved. In this embodiment, crest 815 may be described as curved about insert axis 808 as median line 821 generally curves around insert axis 808 with its concave side facing insert axis 808.

Figure 19:
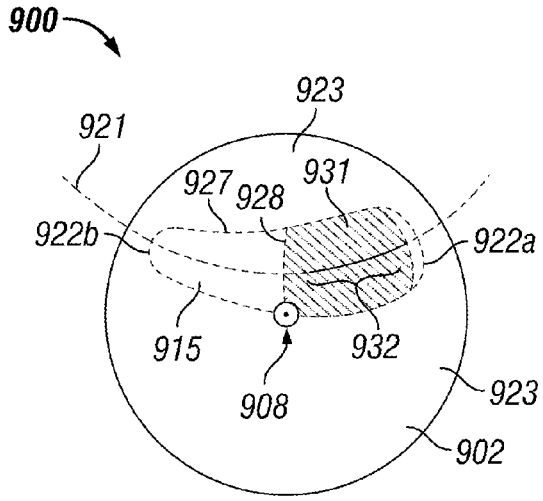

Referring now to FIG. 19, an insert 900 having an insert axis 908, a cutting portion 902, and an elongate crest 915 with a cutting tip 931 is illustrated in schematic fashion. Crest 915 has a top profile 927, and cutting tip 931 has a top profile 928. For purposes of clarity and further explanation, cutting tip 931 is shown shaded in FIG. 19. Apex 932 is represented by a line in this embodiment since crest 915 includes an elongate ridge substantially at the extension height of insert 900.

Similar to insert 100, elongate arcuate crest 915 extends along a crest median line 921 between crest ends 922*a, b*. Further, moving from crest ends 922*a, b* toward apex 932 along elongate crest 915, the transverse radius of curvature and the transverse width of crest 915 generally increase, reaching maximums at apex 932. However, in this embodiment, crest 915 and crest median line 921 are curved or arcuate in top axial view. In particular, contrary to insert 800 previously described, crest 915 does not curve around insert axis 908, but rather, may be described as curving away from insert axis 908 since the concave side of crest 915 faces away from axis 908. In addition, in this embodiment, crest flanks 923 taper towards one another as they extend from the base of insert 900 towards the top of crest 915, and also diverge from one another as they extend from relatively larger crest end 922*a* to relatively narrow crest end 922*b*. Still further, crest 915 and median line 922 are offset from insert axis 908, and further, apex 932 and cutting tip 931 are offset from insert axis 908 and generally positioned proximal crest end 922*a* (the larger crest end) and distal crest end 922*b* (the smaller crest end). Thus, apex 932 and cutting tip 931 are not equidistant from crest ends 922*a, b*.

Figure 20:
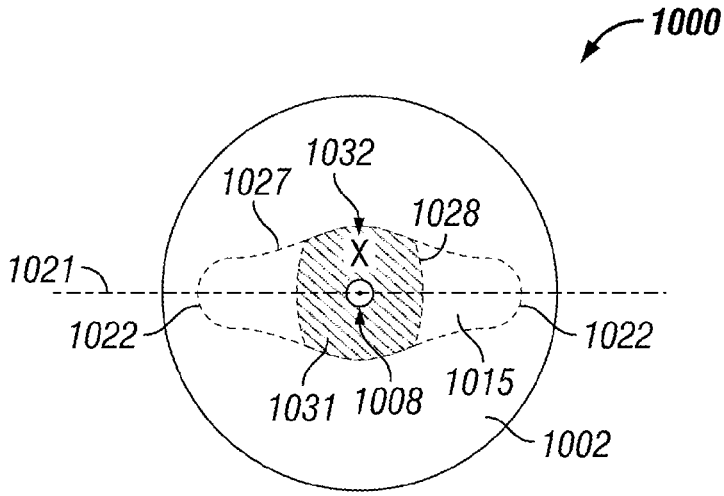

Referring now to FIG. 20, an insert 1000 having an insert axis 1008, a cutting portion 1002, and an elongate crest 1015 with a cutting tip 1031 is illustrated in schematic fashion. Crest 1015 has a top profile 1027, and cutting tip 1031 has a top profile 1028. For purposes of clarity and further explanation, cutting tip 1031 is shown shaded in FIG. 20. The apex 1032 of crest 1015 is denoted by an "X".

Similar to insert 100 previously described, elongate crest 1015 extends generally linearly along a crest median line 1021 between crest ends 1022. Insert axis 1008 and cutting tip 1031 are positioned generally in the middle of crest 1015. Moving from crest ends 1022 toward apex 1032 on elongate crest 1015, the transverse radius of curvature and transverse width of crest 1015 generally increase, reaching maximums at apex 1032. However, unlike insert 100 previously described, apex 1032 is offset from insert axis 1008 and crest median line 1021. In other words, apex 1032 does not lie on crest median line 1021.

Figure 21:
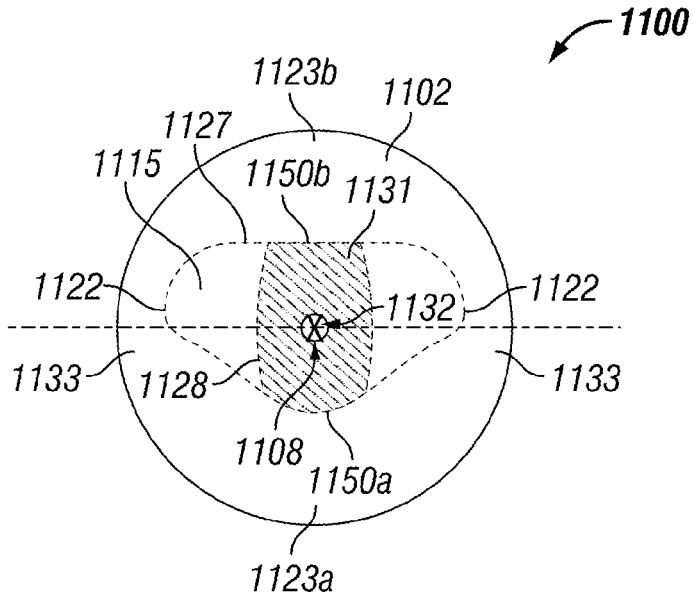

Referring now to FIG. 21, an insert 1100 having an insert axis 1108, a cutting portion 1102, and an elongate crest 1115 with a cutting tip 1131 is illustrated in schematic fashion. Crest 1115 has a top profile 1127, and cutting tip 1131 has a top profile 1128. For purposes of clarity and further explanation, cutting tip 1131 is shown shaded in FIG. 21. The apex 1132 of crest 1115 is denoted by an "X".

Similar to insert 100 previously described, elongate crest 1115 extends generally linearly along a crest median line 1121 between crest ends 1122. Insert axis 1108, cutting tip 1131, and apex 1132 are positioned generally in the middle of crest 1115. And further, elongate crest 1115 is generally centered about insert axis 1108. Moving from crest ends 1122 toward apex 1132 on elongate crest 1115, the transverse radius of curvature and transverse width of crest 1115 generally increase, reaching maximums at apex 1132.

In addition, similar to insert 100, a pair of flanking surfaces 1123*a, b* generally taper or incline towards one another to form elongate chisel crest 1115. A pair of lateral side surfaces 1133 are positioned between flaking surfaces 1123*a, b*, and generally extend between crest ends 1122 and the base of insert 1100. However, unlike insert 100, one flanking surface 1123*a* of insert 1100 is convex or bowed outward between lateral side surfaces 1133, while the other flaking surface 1123*b* of insert 1100 is generally flat or planar between lateral side surfaces. As a result, top profile 1127 of crest 1115 may be described as including a first side 1150*a* that is convex, and a second side 1150*b* that is substantially straight or linear.

The materials used in forming the various portions of the cutter elements described herein (e.g., inserts 100, 300) may be particularly tailored to best perform and best withstand the type of cutting duty experienced by certain portion(s) of the cutter element. For example, it is known that as a rolling cone cutter rotates within the borehole, different portions of a given insert will lead as the insert engages the formation and thereby be subjected to greater impact loading than a lagging or following portion of the same insert. With many conventional inserts, the entire cutter element was made of a single material, a material that of necessity was chosen as a compromise between the desired wear resistance or hardness and the necessary toughness. Likewise, certain conventional gage cutter elements include a portion that performs mainly side wall cutting, where a hard, wear resistant material is desirable, and another portion that performs more bottom hole cutting, where the requirement for toughness predominates over wear resistance. With the inserts 100, 200 described herein, the materials used in the different regions of the cutting portion can be varied and optimized to best meet the cutting demands of that particular portion.

More particularly, because the cutting tip (e.g., cutting tip 131, 331) portion of the inserts are intended to experience more force per unit area upon the insert's initial contact with the formation, and to penetrate deeper than the remainder of the crests (e.g., chisel crests 115, 315) it is desirable, in certain applications, to form different portions of the inserts' cutting portion of materials having differing characteristics. In particular, in at least one embodiment, cutting tip 131 of insert 100 is made from a tougher, more facture-resistant material than the remainder of crest 115. In this example, the portions of chisel crest 115 outside cutting tip 131 are made of harder, more wear-resistant materials.

Cemented tungsten carbide is a material formed of particular formulations of tungsten carbide and a cobalt binder (WC—Co) and has long been used as cutter elements due to the material's toughness and high wear resistance. Wear resistance can be determined by several ASTM standard test methods. It has been found that the ASTM B611 test correlates well with field performance in terms of relative insert wear life. It has further been found that the ASTM B771 test, which measures the fracture toughness (Klc) of cemented tungsten carbide material, correlates well with the insert breakage resistance in the field.

It is commonly known that the precise WC—Co composition can be varied to achieve a desired hardness and toughness. Usually, a carbide material with higher hardness indicates higher resistance to wear and also lower toughness or lower resistance to fracture. A carbide with higher fracture toughness normally has lower relative hardness and therefore lower resistance to wear. Therefore there is a trade-off in the material properties and grade selection.

It is understood that the wear resistance of a particular cemented tungsten carbide cobalt binder formulation is dependent upon the grain size of the tungsten carbide, as well as the percent, by weight, of cobalt that is mixed with the tungsten carbide. Although cobalt is the preferred binder metal, other binder metals, such as nickel and iron can be used advantageously. In general, for a particular weight percent of cobalt, the smaller the grain size of the tungsten carbide, the more wear resistant the material will be. Likewise, for a given grain size, the lower the weight percent of cobalt, the more wear resistant the material will be. However, another trait critical to the usefulness of a cutter element is its fracture toughness, or ability to withstand impact loading. In contrast to wear resistance, the fracture toughness of the material is increased with larger grain size tungsten carbide and greater percent weight of cobalt. Thus, fracture toughness and wear resistance tend to be inversely related. Grain size changes that increase the wear resistance of a given sample will decrease its fracture toughness, and vice versa.

As used herein to compare or claim physical characteristics (such as wear resistance, hardness or fracture-resistance) of different cutter element materials, the term "differs" or "different" means that the value or magnitude of the characteristic being compared varies by an amount that is greater than that resulting from accepted variances or tolerances normally associated with the manufacturing processes that are used to formulate the raw materials and to process and form those materials into a cutter element. Thus, materials selected so as to have the same nominal hardness or the same nominal wear resistance will not "differ," as that term has thus been defined, even though various samples of the material, if measured, would vary about the nominal value by a small amount.

There are today a number of commercially available cemented tungsten carbide grades that have differing, but in some cases overlapping, degrees of hardness, wear resistance, compressive strength and fracture toughness. Some of such grades are identified in U.S. Pat. No. 5,967,245, the entire disclosure of which is hereby incorporated by reference.

Embodiments of the inserts described herein (e.g., insert 100) may be made in any conventional manner such as the process generally known as hot isostatic pressing (HIP). HIP techniques are well known manufacturing methods that employ high pressure and high temperature to consolidate metal, ceramic, or composite powder to fabricate components in desired shapes. Information regarding HIP techniques useful in forming inserts described herein may be found in the book *Hot Isostatic Processing* by H. V. Atkinson and B. A. Rickinson, published by IOP Publishing Ptd., ©1991 (ISBN 0-7503-0073-6), the entire disclosure of which is hereby incorporated by this reference. In addition to HIP processes, the inserts and clusters described herein can be made using other conventional manufacturing processes, such as hot pressing, rapid omnidirectional compaction, vacuum sintering, or sinter-HIP.

Some embodiments of the inserts described herein (e.g., inserts 100, 300) may also include coatings comprising differing grades of super abrasives. Super abrasives are significantly harder than cemented tungsten carbide. As used herein, the term "super abrasive" means a material having a hardness of at least 2,700 Knoop (kg/mm$^2$). PCD grades have a hardness range of about 5,000-8,000 Knoop (kg/mm$^2$) while PCBN grades have hardnesses which fall within the range of about 2,700-3,500 Knoop (kg/mm$^2$). By way of comparison, conventional cemented tungsten carbide grades typically have a hardness of less than 1,500 Knoop (kg/mm$^2$). Such super abrasives may be applied to the cutting surfaces of all or some portions of the inserts. In many instances, improvements in wear resistance, bit life and durability may be achieved where only certain cutting portions of inserts 100, 200 include the super abrasive coating.

Certain methods of manufacturing cutter elements with PDC or PCBN coatings are well known. Examples of these methods are described, for example, in U.S. Pat. Nos. 5,766,394, 4,604,106, 4,629,373, 4,694,918 and 4,811,801, the disclosures of which are all incorporated herein by this reference.

As one specific example of employing superabrasives to insert 100, reference is again made to FIG. 3. As shown therein, cutting tip 131 may be made of a relatively tough tungsten carbide, and be free of a superabrasive coating, such as diamond, given that it must withstand more impact loading than the remainder of chisel crests 115, respectively. It is known that diamond coatings are susceptible to chipping and spalling of the diamond coating when subjected to repeated impact forces. However, the portions of crest 115 outside of cutting tip 131 and distal apex 132 may be made of a first grade of tungsten carbide and coated with a diamond or other superabrasive coating to provide the desired wear resistance. Thus, according to these examples, employing multiple materials and/or selective use of superabrasives, the bit designer, and ultimately the driller, is provided with the opportunity to increase ROP, and bit durability.

While preferred embodiments have been shown and described, modifications thereof can be made by one skilled in the art without departing from the spirit or teaching herein. The embodiments described herein are exemplary only and are not limiting. Many variations and modifications of the system and apparatus are possible and are within the scope of the invention. Accordingly, the scope of protection is not limited to the embodiments described herein, but is only limited by the claims which follow, the scope of which shall include all equivalents of the subject matter of the claims.

What is claimed is:

1. An insert for a drill bit comprising:

a base portion;

a cutting portion extending from the base portion, wherein the cutting portion includes a pair of flanking surfaces that taper towards one another to form an elongate chisel crest having a peaked ridge;

wherein the elongate chisel crest extends between a first crest end and a second crest end, and has an apex positioned between the first and second crest ends, the apex defining an extension height for the insert;

wherein a transverse cross-section at the apex has an apex transverse radius of curvature, a transverse cross-section at the first crest end has a first crest end transverse radius of curvature that is less than the apex transverse radius of curvature, and a transverse cross-section taken at the second crest end has a second crest end transverse radius of curvature that is less than the apex transverse radius of curvature;

wherein the apex transverse radius of curvature is at least 10% larger than the first crest end transverse radius of curvature, and at least 10% larger than the second crest end transverse radius of curvature.

2. The insert of claim 1 wherein the apex transverse radius of curvature is at least 20% larger than the first crest end transverse radius of curvature, and at least 20% larger than the second crest end transverse radius of curvature.

3. The insert of claim 1 wherein the transverse cross-section at the apex has an apex transverse width at a depth D measured perpendicularly from the peaked ridge, the transverse cross-section at the first crest end has a first crest end transverse width at the depth D measured perpendicularly from the peaked ridge that is less than the apex transverse width, and the transverse cross-section at the second crest end has a second crest end transverse width at the depth 0 measured perpendicularly from the peaked ridge that is less than the apex transverse width; and wherein the ratio of the depth 0 to the extension height is 0.10.

4. The insert of claim 3 wherein the apex transverse width is at least 10% larger than the first crest end transverse width, and at least 10% larger than the second crest end transverse width.

5. The insert of claim 4 wherein the apex transverse width is at least 20% larger than the first crest end transverse width, and at least 20% larger than the second crest end transverse width.

6. The insert of claim 1 wherein the transverse radius of curvature of the elongate crest increases moving from the first crest end toward the apex, and increases moving from the second crest end towards the apex.

7. The insert of claim 1 wherein the elongate chisel crest further comprises a domed cutting tip about the apex, a first lateral side segment extending between the cutting tip and the first crest end, and a second lateral side segment extending between the cutting tip and the second crest end, and wherein the first and second lateral side segments of the elongate chisel crest are substantially straight in front profile view.

8. The insert of claim 1 wherein the apex is equidistant from the first crest end and the second crest end.

9. An insert for a drill bit comprising:

a base portion;

a cutting portion extending from the base portion, wherein the cutting portion includes a pair of flanking surfaces that taper towards one another to form an elongate chisel crest having a peaked ridge;

wherein the elongate chisel crest extends between a first crest end and a second crest end, and has an apex positioned between the first and second crest ends, the apex defining an extension height for the insert;

wherein the elongate chisel crest has a transverse radius of curvature that increases moving from the first crest end toward the apex, and increases moving from the second crest end towards the apex;

wherein the elongate chisel crest has a transverse width at a depth D measured perpendicularly from the peaked ridge, wherein of the transverse width of the elongate crest increases moving from the first crest end toward the apex, and increases moving from the second crest end towards the apex; and wherein the ratio of the depth D to the extension height is 0.10.

10. The insert of claim 9 wherein the transverse radius of curvature of the elongate chisel crest is greatest at the apex, and wherein the transverse width of the elongate crest at the depth D measured perpendicularly from the peaked ridge is greatest at the apex.

11. A drill bit for cutting a borehole having a borehole sidewall, comer and bottom, the drill bit comprising:

a bit body including a bit axis;

a rolling cone cutter mounted on the bit body and adapted for rotation about a cone axis;

at least one insert having a base portion secured in the rolling cone cutter and having a cutting portion extending therefrom;

wherein the cutting portion includes a pair of flanking surfaces tapering towards one another to form an elongate chisel crest having a peaked ridge;

wherein the elongate chisel crest extends between a first crest end and a second crest end, and has an apex positioned between the first and second crest ends. the apex defining an extension height of the at least one insert;

wherein a transverse cross-section at the apex has an apex transverse radius of curvature, a transverse cross-section at the first crest end has a first crest end transverse radius of curvature that is less than the apex transverse radius of curvature, and a transverse cross-section taken at the second crest end has a second crest end transverse radius of curvature that is less than the apex transverse radius of curvature;

wherein the apex transverse radius of curvature is at least 10% larger than the first crest end transverse radius of curvature, and at least 10% larger than the second crest end transverse radius of curvature.

12. The insert of claim 11 wherein the transverse cross-section at the apex has an apex transverse width at a depth 0 measured perpendicularly from the peaked ridge, the transverse cross-section at the first crest end has a first crest end transverse width at the depth 0measured perpendicularly from the peaked ridge that is less than the apex transverse width, and the transverse cross-section at the second crest end has a second crest end transverse width at the depth 0 measured perpendicularly from the peaked ridge that is less than the apex transverse width; and wherein the ratio of the depth 0 to the extension height is 0.10.

13. The insert of claim 12 wherein the apex transverse width is at least 10% larger than the first crest end transverse width, and at least 10% larger than the second crest end transverse width.

14. The insert of claim 13 wherein the apex transverse radius of curvature is at least 20% larger than the first crest end transverse radius of curvature, and at least 20% larger than the second crest end transverse radius of curvature, and wherein the apex transverse width is at least 20% larger than the first crest end transverse width, and at least 20% larger than the second crest end transverse width.

15. A drill bit for cutting a borehole having a borehole sidewall, comer and bottom, the drill bit comprising:

a bit body including a bit axis;

a rolling cone cutter mounted on the bit body and adapted for rotation about a cone axis;

at least one insert having a base portion secured in the rolling cone cutter and having a cutting portion extending therefrom;

wherein the cutting portion includes a pair of flanking surfaces tapering towards one another to form an elongate chisel crest having a peaked ridge;

wherein the elongate chisel crest extends between a first crest end and a second crest end, and has an apex positioned between the first and second crest ends, the apex defining an extension height of the at least one insert;

wherein the elongate chisel crest has a transverse width at a uniform depth D measured perpendicularly from the peaked ridge, wherein the transverse width of the elongate crest increases moving from the first crest end toward the apex, and increases moving from the second crest end towards the apex, the ratio of the depth D to the extension height being 0.10;

wherein the transverse width of the elongate chisel crest at the apex is at least 20% larger than the transverse width of the elongate chisel crest at the first crest end, and at least 20% larger than the transverse width at the second crest end.

16. The drill bit of claim 15 further comprising a row of inserts, each insert having a base portion secured in the rolling cone cutter and having a cutting portion extending therefrom;

wherein the cutting portion of each' insert includes a pair of flanking surfaces tapering towards one another to form an elongate chisel crest having a peaked ridge;

wherein the elongate chisel crest of each insert extends between a first crest end and a second crest end, and has an apex positioned between the first and second crest ends, the apex defining an extension height of the at least one insert;

wherein each elongate chisel crest has a transverse width at a depth 0 measured perpendicularly from its peaked ridge, wherein the transverse width of each elongate crest increases moving from the first crest end toward the apex, and increases moving from the second crest end towards the apex, the ratio of the depth 0 to the extension height is 0.10.

* * * * *

UNITED STATES PATENT AND TRADEMARK OFFICE

CERTIFICATE OF CORRECTION

PATENT NO. : 8,205,692 B2
APPLICATION NO. : 11/858359
DATED : June 26, 2012
INVENTOR(S) : Scott D. Mcdonough et al.

It is certified that error appears in the above-identified patent and that said Letters Patent is hereby corrected as shown below:

| | |
|---|---|
| Title Page Item (56) References Cited, page 2, right column, Other Publications, line 31 | Delete "Apr. 29," Insert -- Apr. 22, -- |
| In the Claims | |
| Column 22, Claim 9, line 23 | After "wherein" Delete "of" |
| Column 22, Claim 11, line 47 | Delete "ends." Insert -- ends, -- |
| Column 22, Claim 12, line 65 | Delete "0measured" Insert -- 0 measured -- |

Signed and Sealed this
Thirtieth Day of April, 2013

Teresa Stanek Rea
*Acting Director of the United States Patent and Trademark Office*